US012797671B2

(12) United States Patent
Woo et al.

(10) Patent No.: US 12,797,671 B2
(45) Date of Patent: Nov. 17, 2026

(54) EXERCISE EQUIPMENT

(71) Applicant: LG ELECTRONICS INC., Seoul (KR)

(72) Inventors: Se Young Woo, Seoul (KR); Jeong Uk Lee, Seoul (KR); Tae Hee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 313 days.

(21) Appl. No.: 18/726,593

(22) PCT Filed: Nov. 1, 2023

(86) PCT No.: PCT/KR2023/017188

§ 371 (c)(1),
(2) Date: Jul. 3, 2024

(87) PCT Pub. No.: WO2024/143845

PCT Pub. Date: Jul. 4, 2024

(65) Prior Publication Data

US 2026/0249128 A1 Aug. 27, 2026

(30) Foreign Application Priority Data

Dec. 29, 2022 (KR) ..... 10-2022-0188543
Oct. 17, 2023 (KR) ..... 10-2023-0138249

(51) Int. Cl.
*A63B 21/00* (2006.01)
*A63B 21/005* (2006.01)
*A63B 71/00* (2006.01)

(52) U.S. Cl.
CPC ..... *A63B 21/153* (2013.01); *A63B 21/0058* (2013.01); *A63B 21/4033* (2015.10);
(Continued)

(58) Field of Classification Search
CPC ..... A63B 21/0058; A63B 21/153; A63B 21/4033; A63B 71/0036; A63B 2208/0204; A63B 2209/08; A63B 2220/833
See application file for complete search history.

(56) References Cited

U.S. PATENT DOCUMENTS 6,347,682 B1 2/2002 Buchner
7,579,742 B1 8/2009 Rittenhouse
(Continued)

FOREIGN PATENT DOCUMENTS

CN 101629619 1/2010
CN 103154546 6/2013
(Continued)

OTHER PUBLICATIONS

Korean Office Action dated Nov. 28, 2025 issued in Application No. 10-2024-7026767.
(Continued)

*Primary Examiner* — Joshua Lee
(74) *Attorney, Agent, or Firm* — KED & ASSOCIATES, LLP

(57) ABSTRACT

There is provided exercise equipment that provides an exercise load to the user to enable strength exercise. Exercise equipment according to one aspect of the present disclosure includes: a body part having an accommodation space formed therein and an upper surface formed in a plate shape; a cable part having one end coupled to the accommodation space and the other end exposed to the outside through an outlet of the body part, and configured to change in its length by external force; and a driving part coupled to one end of the cable part in the accommodation space and configured to provide the cable part with an exercise load to resist the external force, wherein the driving part includes a driving motor configured to generate rotational force around
(Continued)

a motor shaft in the longitudinal direction, a bobbin installed to rotate around a bobbin shaft in the longitudinal direction and configured to wind one end of the cable part, and a timing belt configured to connect the driving motor and the bobbin, and rotate the bobbin using the rotational force of the driving motor.

21 Claims, 15 Drawing Sheets

(52) U.S. Cl.
CPC .. *A63B 71/0036* (2013.01); *A63B 2208/0204* (2013.01); *A63B 2209/08* (2013.01); *A63B 2220/833* (2013.01)

(56) References Cited

U.S. PATENT DOCUMENTS

| | | | | |
|---|---|---|---|---|
| 11,007,398 | B2 * | 5/2021 | Neuhaus | A63B 23/03525 |
| 2003/0203796 | A1 | 10/2003 | Yu | |
| 2019/0344115 | A1 * | 11/2019 | Neuhaus | A63B 21/0058 |
| 2019/0344123 | A1 | 11/2019 | Rubin et al. | |
| 2020/0047030 | A1 | 2/2020 | Ward et al. | |
| 2020/0276465 | A1 | 9/2020 | Orady et al. | |
| 2021/0236876 | A1 | 8/2021 | Gregory | |
| 2022/0184452 | A1 * | 6/2022 | Valente | A63B 21/0058 |
| 2023/0405404 | A1 | 12/2023 | Belsham et al. | |
| 2024/0189651 | A1 | 6/2024 | Drayer et al. | |
| 2025/0288850 | A1 | 9/2025 | Nayak | |

FOREIGN PATENT DOCUMENTS

| | | |
|---|---|---|
| CN | 109416289 | 3/2019 |
| CN | 109621330 | 4/2019 |
| CN | 111601646 | 8/2020 |
| CN | 111801167 | 10/2020 |
| CN | 113332661 | 9/2021 |
| CN | 115120466 | 9/2022 |
| JP | 2022-547237 | 11/2022 |
| KR | 10-2002-0076201 | 10/2002 |
| KR | 20-2008-0002277 | 7/2008 |
| KR | 10-2010-0089971 | 8/2010 |
| KR | 10-2011-0072669 | 6/2011 |
| KR | 2020 0079106 | 7/2020 |
| KR | 10-2158338 | 11/2020 |
| KR | 10-2188955 | 12/2020 |
| KR | 10-2022-0162032 | 12/2022 |
| KR | 10-2023-0050202 | 4/2023 |
| KR | 2024/0033922 | 3/2024 |
| WO | WO 2006-113415 | 10/2006 |
| WO | WO 2022-212737 | 10/2022 |
| WO | WO 2022/235749 | 11/2022 |

OTHER PUBLICATIONS

International Search Report dated Feb. 2, 2024 issued in Application No. PCT/KR2023/017188.

U.S. Office Action issued in U.S. Appl. No. 18/838,424 dated Feb. 3, 2026.

Extended European Search Report dated Jun. 30, 2025, issued in Application No. 23912525.5.

Extended European Search Report dated May 12, 2025, issued in Application No. 23912518.0.

Korean Office Action dated Mar. 24, 2025, issued in Application No. 10-2023-0138249.

Chinese Office Action dated Jun. 11, 2026, issued in Application No. 202380020979.6.

* cited by examiner

EXERCISE EQUIPMENT

CROSS-REFERENCE TO RELATED PATENT APPLICATIONS

This application is a U.S. National Stage Application under 35 U.S.C. § 371 of PCT Application No. PCT/KR2023/017188, filed Nov. 1, 2023, which claims priority to Korean Patent Application Nos. 10-2022-0188543, filed Dec. 29, 2022 and 10-2023-0138249, filed Oct. 17, 2023, whose entire disclosures are hereby incorporated by reference.

TECHNICAL FIELD

The present disclosure relates to exercise equipment and, more specifically, to exercise equipment that provides exercise loads to a user to enable strength training.

BACKGROUND

In general, exercise equipment used for strength training is configured to repeat muscle relaxation and contraction by pushing or pulling a lever and/or cable connected to a weight having a certain weight.

Exercise equipment used for strength training has been developed to have various shapes and structures depending on exercise parts of the user and purposes, and is being used. In addition, in recent years, home training, which involves exercising alone at home without visiting a fitness center, has become popular as a form of self-management, and in line with this trend, a variety of exercise equipment for home training is being proposed.

Among such exercise equipment, for example, there is mat-type exercise equipment that is a device for performing strength exercises while the user is standing on a main body of the exercise equipment. In the case of this mat-type exercise equipment, the user may perform an exercise by connecting a handle to a cable exposed to the outside of the main body and repeatedly pulling the handle.

In relation to the above-mentioned exercise equipment, Korean Unexamined Patent Publication No. 10-2023-0050202 (hereinafter referred to as "Prior Document 1") discloses mat-type exercise equipment.

Specifically, Prior Document 1 discloses exercise equipment enabling a user to do exercise while standing on the equipment seated on the floor, which includes a device body that provides exercise loads, a wire that extends from the device body to the outside to transmit the exercise load from the device body, and a handle guide module that is installed in the device body and guides extension of the wire from the device body to the outside.

The exercise equipment in Prior Document 1 discloses a structure in which a pair of wires extends from the device body and in which the exercise load generated from one driving motor is transferred to the wires respectively wound around bobbins through a differential having the bobbins provided at the top and bottom, instead of installing driving motors to the respective wires.

Accordingly, since the exercise equipment in Prior Document 1 has the bobbins provided at the top and bottom of the differential, the overall height of the driving structure is increased, so there it is difficult to make slim exercise equipment. In addition, since noise and vibration are inevitably generated due to transmission through engagement of gears inside the differential, a feeling of pulling the wires may deteriorate during exercise. In addition, it may be difficult to precisely detect or control the extension amount of each wire divided through the differential.

In addition, Japanese Unexamined Patent Publication No. 2022-547237 (hereinafter referred to as "Prior Document 2") discloses a fitness training device and system.

Specifically, Prior Document 2 also discloses exercise equipment enabling a user to do exercise while standing on the equipment seated on the floor, which includes a base, at least one retractable line installed in the base, and a load generator installed in the base to apply a selectively adjustable load to the line.

The exercise equipment in Prior Document 2 discloses a structure in which the rotational force of the motor is transmitted to a spool on which a cable is wound such that the cable is unwound to the outside, and in which the motor shaft is arranged transversely with respect to the base to transmit rotational force to the spool rotates around the transverse axis.

Accordingly, in the exercise equipment of Prior Document 2, the height of the base must be increased in order to use a motor with a relatively large radius, so it is difficult to increase the output of the motor due to the limited thickness of the exercise equipment. Additionally, the exercise equipment does not absolutely consider the structure capable of providing an exercise load at an appropriate load/pulling speed when using a motor of higher torque therein.

As described above, the exercise equipment used for strength training is required to be manufactured to be slim while providing an appropriate exercise load even if it uses a motor of higher torque. In addition, the exercise equipment is required to appropriately control the user's feeling of pulling the cable, and to precisely detect and control the pulled length of each of a plurality of cables, thereby improving the usability of the exercise equipment.

DISCLOSURE

Technical Problem

The present disclosure aims to solve the above problems with exercise equipment used for strength training.

Specifically, the present disclosure aims to provide exercise equipment capable of being manufactured to be slim while using a motor of higher torque by optimizing the structure of the driving part for providing an exercise load.

In addition, the present disclosure aims to provide exercise equipment capable of more easily and stably providing an exercise load to the user who performs strength training by optimizing the structure of the driving part for providing the exercise load.

In addition, the present disclosure aims to provide exercise equipment having a plurality of cables pulled by the user during strength exercise, which provides exercise loads to the respective cables, thereby improving usability thereof.

The technical problems to be solved in the present disclosure are not limited to the technical problems mentioned above, and other technical problems not mentioned will be made clear to those skilled in the art to which the present disclosure belongs from the description below.

Technical Solution

In order to attain the foregoing or other purposes, the exercise equipment according to one aspect of the present disclosure is configured to enable a slim structure even if a driving part providing an exercise load has higher torque. Specifically, a driving motor used in the driving part is configured in a structure capable of generating rotational force around a motor shaft in the longitudinal direction.

In addition, the exercise equipment according to one aspect of the present disclosure is configured such that the structure of the driving part providing the exercise load is constructed in consideration of the characteristics required for strength exercise. Specifically, the driving part is configured in a structure in which the driving motor and the bobbin are separated and connected through a timing belt according to the rotation ratio in the driving part.

In addition, in the exercise equipment according to one aspect of the present disclosure, a body part may be formed to be long in the first direction, and a cable part may be installed to be exposed from the end portion of the body part in the first direction.

In addition, in the exercise equipment according to one aspect of the present disclosure, the driving motor may be disposed inward from the outlet in the first direction, and the bobbin may be disposed in the second direction intersecting the first direction.

In addition, in the exercise equipment according to one aspect of the present disclosure, the bobbin may be lopsidedly disposed from the outlet with respect to the extension line along the first direction so as to maximize the area of the driving motor.

In addition, in the exercise equipment according to one aspect of the present disclosure, the cable part extending from the biased bobbin in the first direction may be bent at the articulation pulley and may extend to the outlet.

In addition, in the exercise equipment according to one aspect of the present disclosure, the driving motor may have an outer rotor structure.

In addition, in the exercise equipment according to one aspect of the present disclosure, the rotation amount of the driving motor may be detected through an encoder magnet and an encoder sensor.

In addition, in the exercise equipment according to one aspect of the present disclosure, the bobbin body around which the cable part is wound and the bobbin sprocket to which the timing belt is fastened may be formed separately.

In addition, in the exercise equipment according to one aspect of the present disclosure, the cable part may be wound according to the sequential heights between the bottom and top of the bobbin body In addition, the exercise equipment according to one aspect of the present disclosure is configured such that the exercise load is independently provided to a plurality of cable parts. Specifically, a plurality of cable parts may be disposed in the body part, and the driving part for providing an exercise load may be installed in each cable part.

In addition, in the exercise equipment according to one aspect of the present disclosure, a controller may be disposed in the space formed between the driving parts in the accommodation space.

In addition, the exercise equipment according to one aspect of the present disclosure may move by rolling on the ground through casters protruding from the body part in the downward direction.

In addition, the exercise equipment according to one aspect of the present disclosure may change the protrusion of the caster with respect to the body part by moving the casters up and down.

In addition, in the exercise equipment according to one aspect of the present disclosure, a guide wall may be installed between the driving part and the outlet to guide the cable part in the corresponding section.

In addition, in the exercise equipment according to one aspect of the present disclosure, a plurality of guide holes may be formed in a shape perforating the guide wall body among the detailed configuration of the guide wall.

In addition, in the exercise equipment according to one aspect of the present disclosure, the body part may include a first body and a second body that are manufactured separately from each other and assembled.

In addition, in the exercise equipment according to one aspect of the present disclosure, concavo-convex surfaces may be formed on the first body and the second body, which correspond to each other and are assembled to engage each other.

In addition, in the exercise equipment according to one aspect of the present disclosure, the first body and the second body may be formed to be symmetrical to each other.

In addition, in the exercise equipment according to one aspect of the present disclosure, the cable part may extend by passing through an outlet part installed in the outlet such that the pulling trajectory of the cable part changes.

In addition, in the exercise equipment according to one aspect of the present disclosure, the minimum exposed length of the cable part may be maintained by a cable stopper formed on the cable part.

In addition, in the exercise equipment according to one aspect of the present disclosure, the strength exercise may be performed by the user holding a handle coupled to a handle connector formed on the cable part.

Solutions to problems sought to be achieved in the present disclosure are not limited to those mentioned above, and other solutions not mentioned above may be clearly understood by those skilled in the art to which the present disclosure belongs from the description below.

DETAILED DESCRIPTION

Hereinafter, preferred embodiments of the present disclosure will be described in detail with reference to the attached drawings. However, in describing the present disclosure, descriptions of already known functions or configurations will be omitted to make the subject matter of the present disclosure clear.

The X direction, Y direction, and Z direction to be described in the embodiments of the present disclosure may be directions orthogonal to each other. Each of the X and Y directions may be parallel to the horizontal direction, and the Z direction may be parallel to the vertical direction. If the X direction is parallel to the left/right direction, the Y direction may be parallel to the front/back direction. If the X direction is parallel to the front/back direction, the Y direction may be parallel to the left/right direction.

Figure 1:
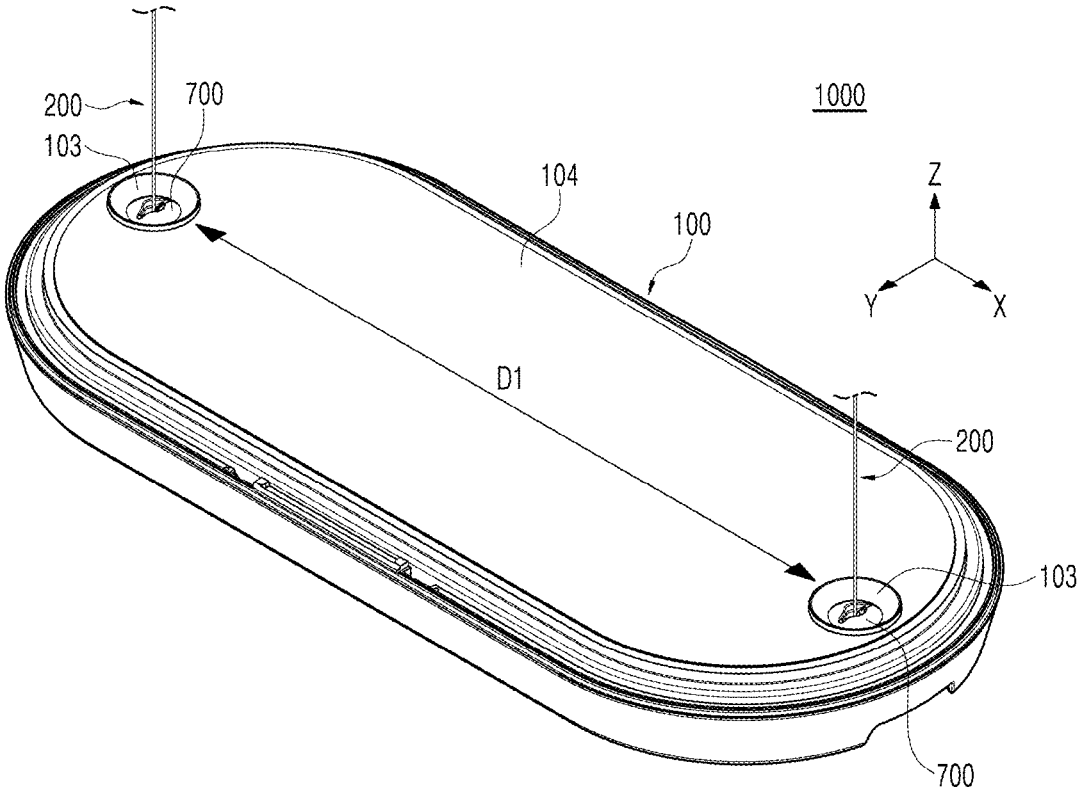
FIG. 1 is a perspective view illustrating exercise equipment according to an embodiment of the present disclosure.
Figure 2:
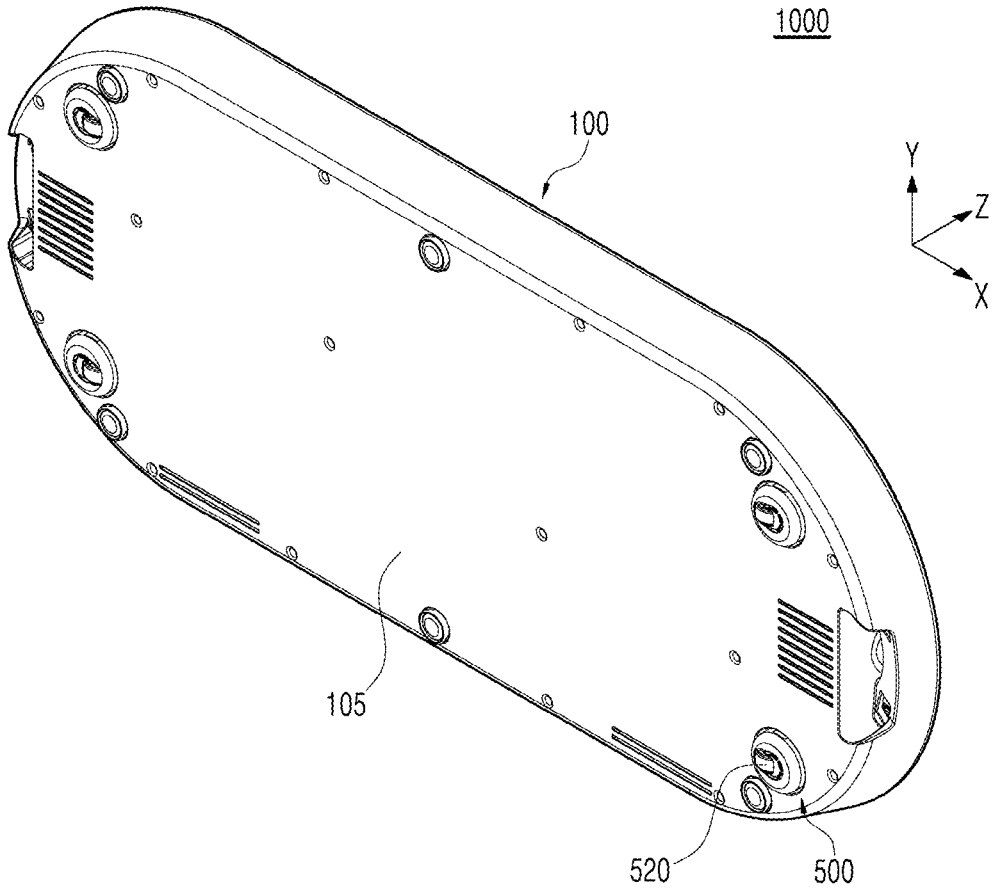
FIG. 2 is a diagram illustrating the exercise equipment in FIG. 1 viewed from another direction.
Figure 3:
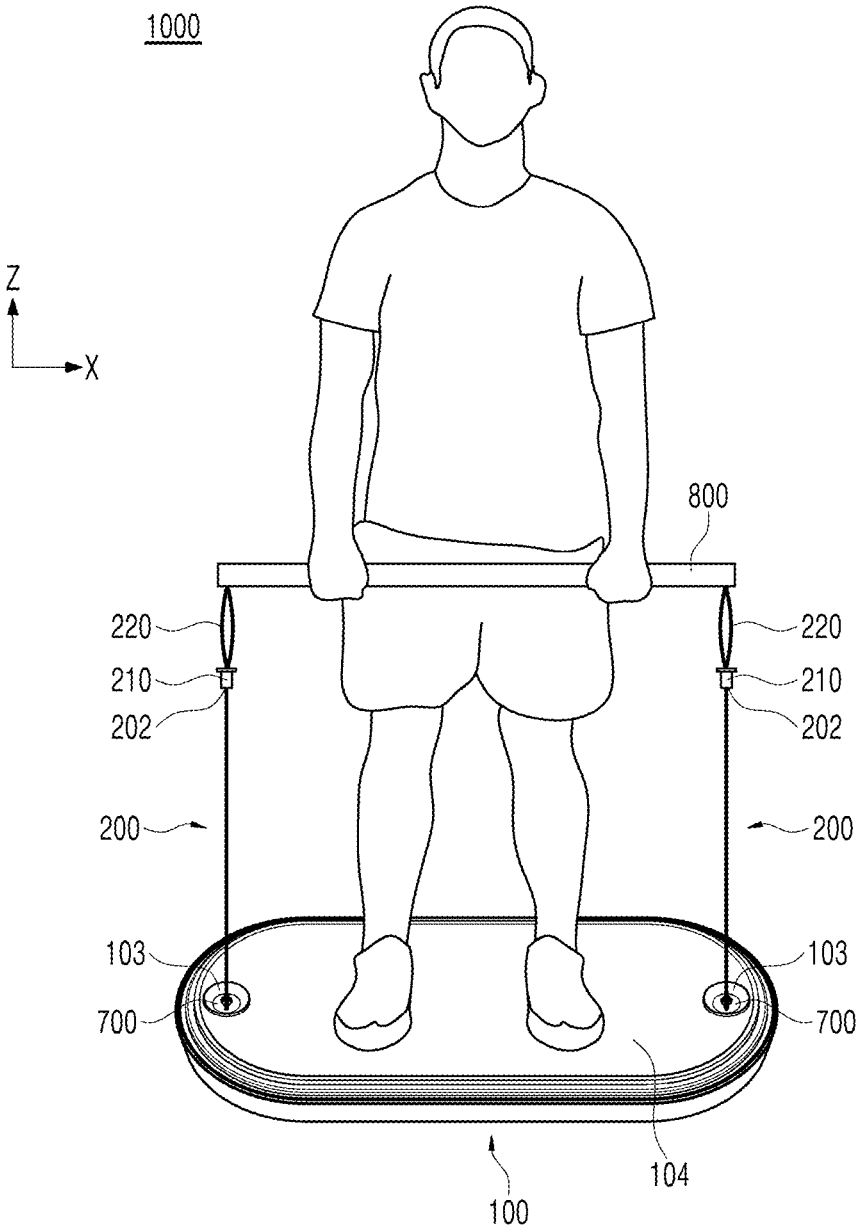
FIGS. 3 and 4 are diagrams illustrating the state of using exercise equipment according to an embodiment of the present disclosure.
Figure 4:
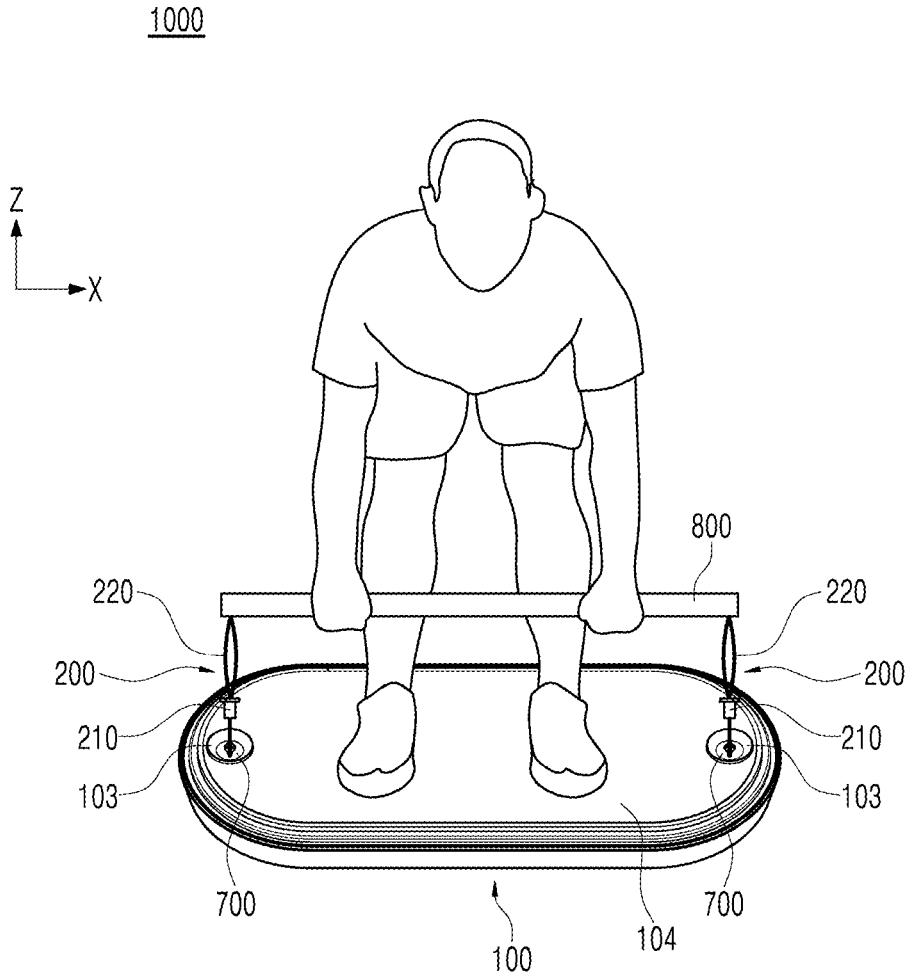

FIG. 1 is a perspective view illustrating exercise equipment 1000 according to an embodiment of the present disclosure. FIG. 2 is a diagram illustrating the exercise equipment 1000 in FIG. 1 viewed from another direction. FIGS. 3 and 4 are diagrams illustrating the state of using exercise equipment 1000 according to an embodiment of the present disclosure.

Referring to FIGS. 1 to 4, the exercise equipment 1000 according to an embodiment of the present disclosure may be used such that the user stands on the exercise equipment 1000 and exercises while being seated on the floor indoors or outdoors.

Specifically, the user may get on the upper surface 104 of a body part 100 with the exercise equipment 1000 installed such that the lower surface 105 of the body part 100 faces the floor, thereby exercising.

In this case, a cable part 200 is installed to extend from the inside of the body part 100 to the outside such that a portion thereof is exposed, and the user may pull the exposed portion of the cable part 200 to perform an exercise.

In particular, when the user pulls the exposed portion of the cable part 200, an exercise load that resists the user's pulling force may be applied to the cable part 200 accommodated inside the body part 100.

Therefore, as shown in FIGS. 3 and 4, the exposed length of the cable part 200 may be increased and reduced by the force of the user pulling the cable part 200 and the exercise load that resists the force. In addition, repeating this process may apply an exercise load to the user, thereby obtaining the effect of strength training.

Meanwhile, FIGS. 3 and 4 exemplarily show an example in which the user exercises by connecting a rod-shaped handle 800 to the cable part 200, but the state of using the exercise equipment 1000 by the user is not limited thereto and may vary depending on the user's exercise part and purposes.

Figure 5:
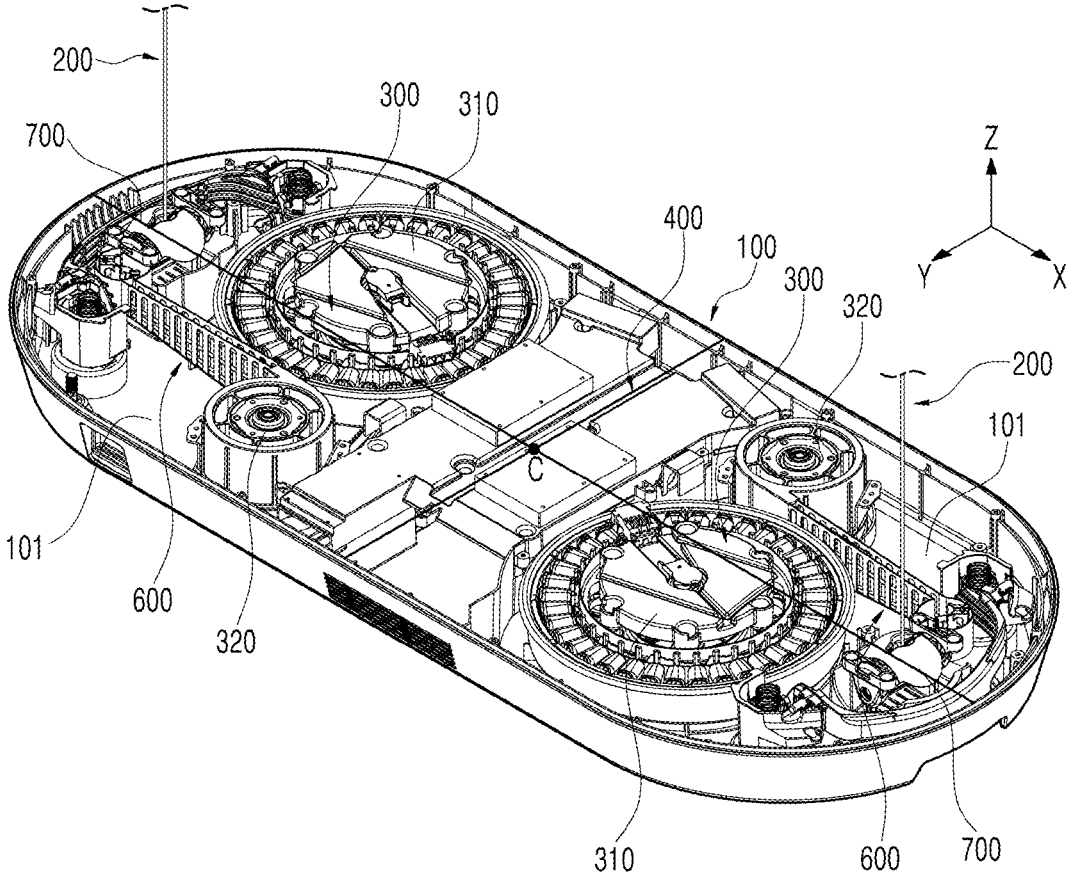
FIG. 5 is a diagram illustrating the primary configurations arranged in an accommodation space in exercise equipment according to an embodiment of the present disclosure.
Figure 6:
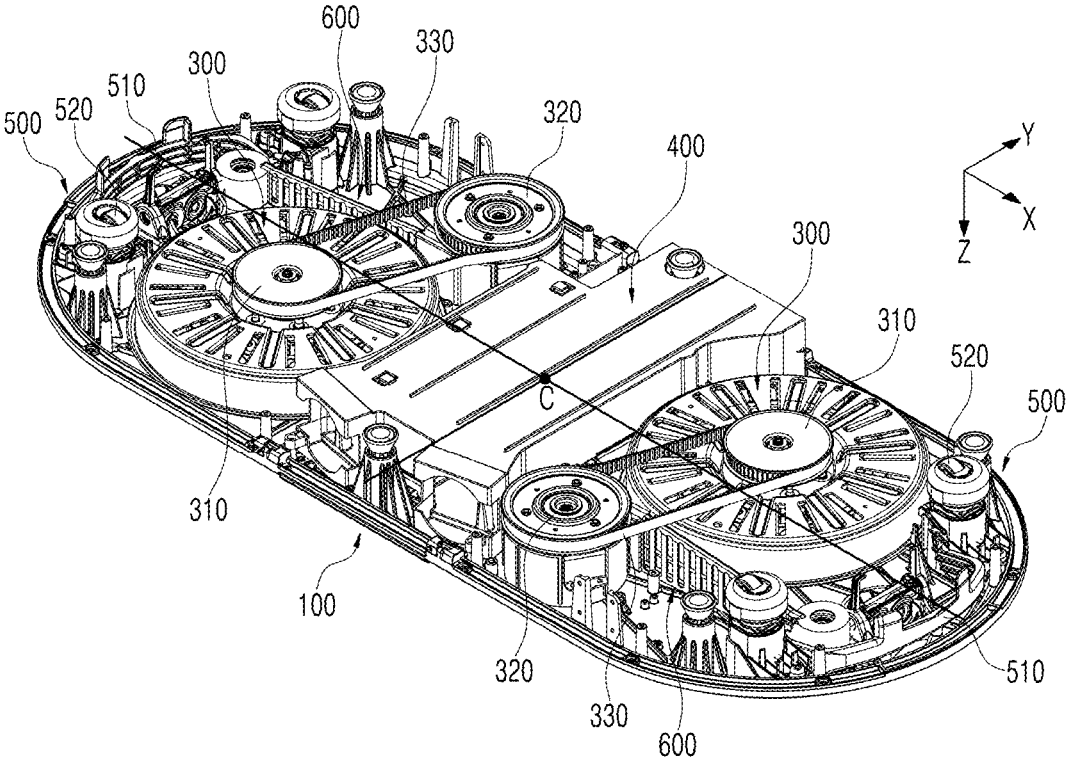
FIG. 6 is a view illustrating the primary configurations in FIG. 5 viewed from another direction.

FIG. 5 is a diagram illustrating the primary configurations arranged in an accommodation space 101 in exercise equipment 1000 according to an embodiment of the present disclosure. FIG. 6 is a view illustrating the primary configurations in FIG. 5 viewed from another direction.

The exercise equipment 1000 according to an embodiment of the present disclosure includes a body part 100, a cable part 200, and a driving part 300.

The body part 100 may have an accommodation space 101 formed therein and an upper surface 104 formed in a plate shape, and may form the primary exterior of the exercise equipment 1000 according to the present embodiment.

Here, the accommodation space 101 is an empty space formed inside the body part 100, and may be a space surrounded by the upper surface 104, the lower surface 105, and the side surfaces of the body part 100. Additionally, the upper surface 104 of the body part 100 may be a surface directed to the Z direction, and the lower surface 105 of the body part 100 may be a surface directed to the opposite direction of the Z direction in FIGS. 1 to 6.

That is, the primary configurations of the exercise equipment 1000 according to the present embodiment may be installed in the accommodation space 101 corresponding to the internal space of the body part 100. In addition, a portion of the cable part 200 installed in the accommodation space 101 of the body part 100 may be exposed to the outside of the body part 100.

Accordingly, the user may perform an exercise by pulling the cable part 200 exposed to the outside of the body part 100 while standing on the upper surface 104 of the body part 100 formed in a plate shape.

The cable part 200 has one end 201 coupled to the accommodation space 101 and the other end 202 exposed to the outside through the outlet 103 of the body part 100, so that the exposed length varies by external force.

Here, one end 201 of the cable part 200 may be one end in the longitudinal direction (or a section from the end to a predetermined length), and the other end 202 of the cable part 200 may be the opposite end in the longitudinal direction (or a section from the end to a predetermined length).

In this case, the outlet 103 may be a through hole formed in a portion of the body part 100, and the cable part 200 may extend from the inside of the body part 100 to the outside through the outlet 103. In addition, the cable part 200 may include a cable, a wire, a rope, or a belt that is formed to extend along the length direction, and the tensile force applied to the part may be transmitted along the length direction.

Accordingly, the external force with which the user pulls on the other end 202 of the cable part 200 may be transmitted to one end 201 of the cable part 200 along the longitudinal direction. In addition, an exercise load may be applied to one end 201 of the cable part 200 coupled to the accommodation space 101 by a driving part 300, which will be described later, and this exercise load may be transmitted to the other end 202 of the cable part 200 along the longitudinal direction.

Therefore, if the user pulls the cable part 200 with an external force greater than the exercise load, the exposed length of the cable part 200 may increase. On the other hand, if the external force with which the user pulls the cable part 200 is smaller than the exercise load, the pulled cable part 200 may return to its original position so that the exposed length of the cable part 200 is reduced.

The driving part 300 is coupled to one end 201 of the cable part 200 in the accommodation space 101 and provides an exercise load to the cable part 200 to resist external force.

That is, the driving part 300 may provide the cable part 200 with an exercise load in a direction in which the exposed portion of the cable part 200 retracts back into the accommodation space 101 of the body part 100.

Therefore, in the process of pulling the cable part 200, the user may feel the exercise load provided from the driving part 300 and adjust the external force for pulling the cable part 200 in response to the exercise load of the driving part 300, thereby performing intended exercise.

Figure 7:
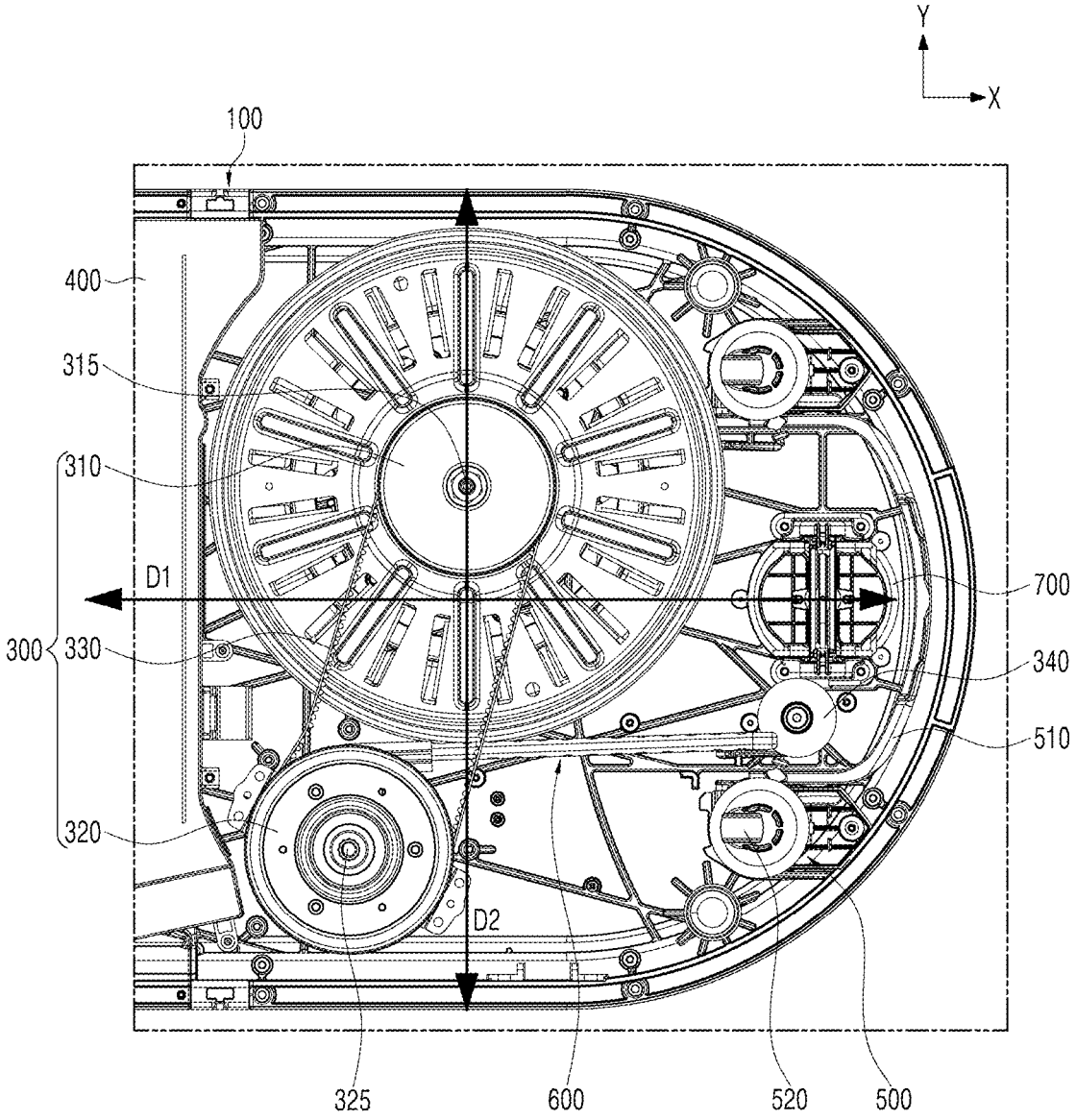
FIG. 7 is a diagram illustrating a driving part in exercise equipment according to an embodiment of the present disclosure.
Figure 8A:
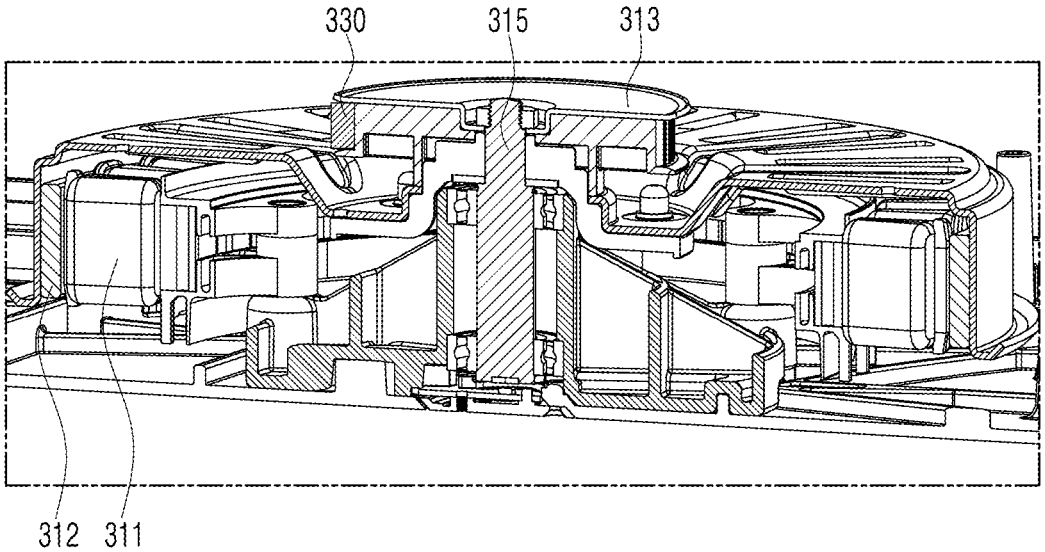
FIGS. 8A and 8B are diagrams illustrating a driving motor in the driving part shown in FIG. 7.
Figure 8B:
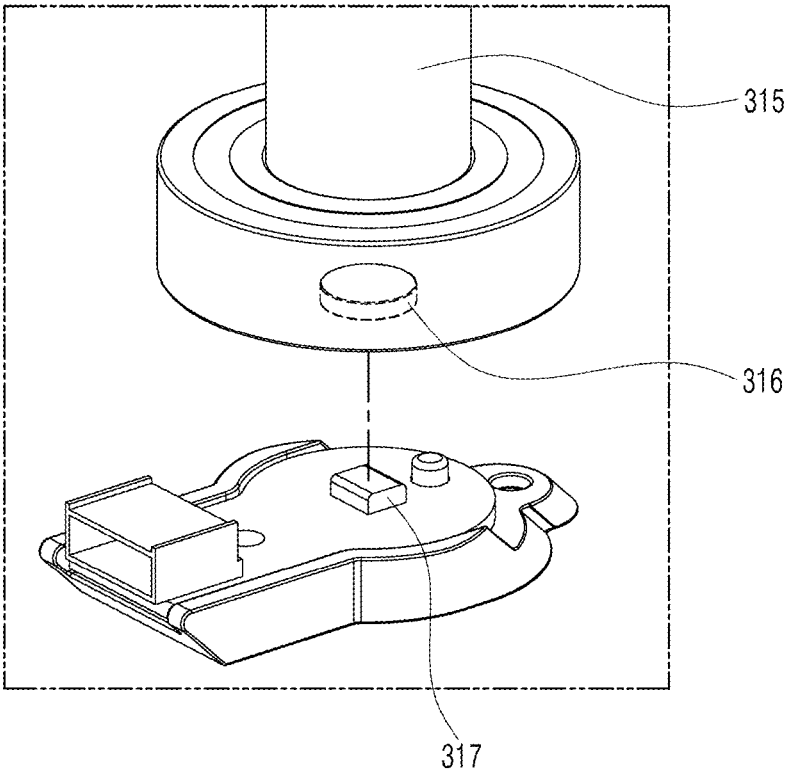
Figure 8C:
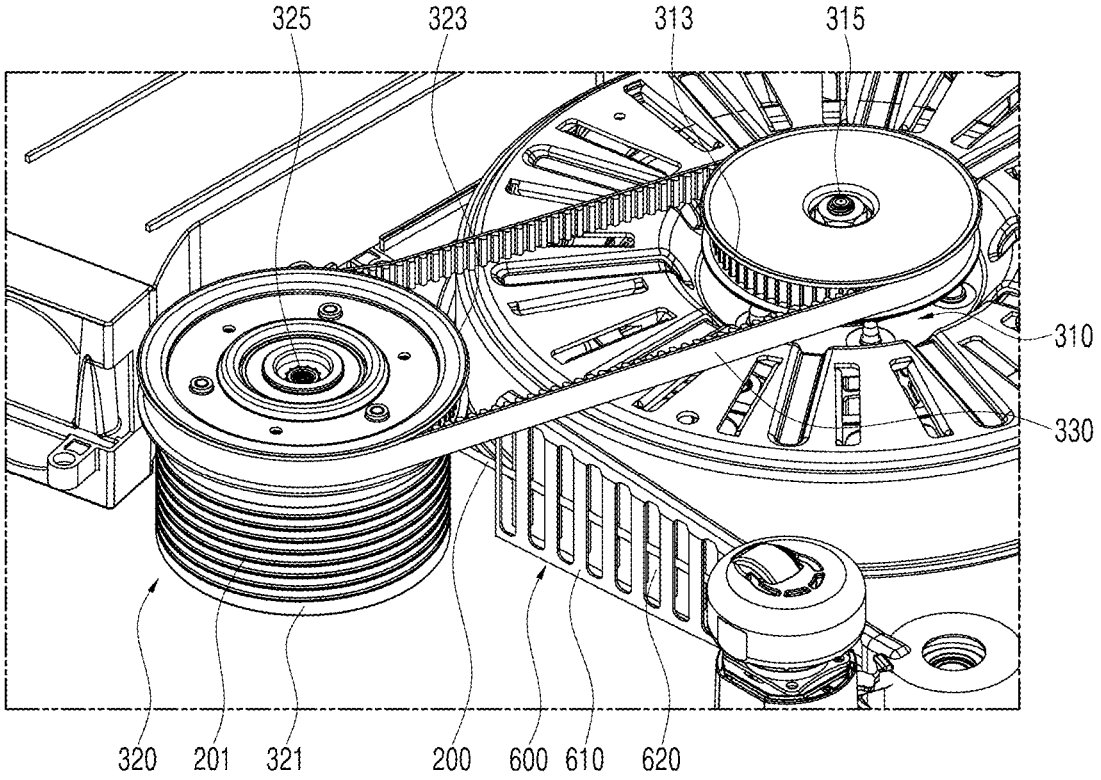
FIG. 8C is a diagram illustrating a bobbin in the driving part shown in FIG. 7.

FIG. 7 is a diagram illustrating a driving part 300 in exercise equipment 1000 according to an embodiment of the present disclosure. FIGS. 8A and 8B are diagrams illustrating a driving motor 310 in the driving part 300 shown in FIG. 7. FIG. 8C is a diagram illustrating a bobbin 320 in the driving part 300 shown in FIG. 7.

In the exercise equipment 1000 according to an embodiment of the present disclosure, the driving part 300 may include a driving motor 310, a bobbin 320, and a timing belt 330.

The driving motor 310 is an element that generates rotational force by electrical energy, and may generate power for the exercise load provided from the driving part 300.

In particular, the driving motor 310 may be installed to generate rotational force around a motor shaft 315 in the longitudinal direction. Here, the longitudinal direction may be a direction parallel to the Z direction with respect to the plane of the body part 200.

Accordingly, the rotation radius of the driving motor 310 may be expanded along the X and Y directions on the plane of the body part 200, and even if the height of the driving motor 310 is not expanded in the Z direction, rotational force of high torque may be generated according to the expanded rotation radius.

As described above, the exercise equipment 1000 according to an embodiment of the present disclosure has a structure in which the driving motor 310 used in the driving part 300 generates rotational force around the motor shaft 315 in the longitudinal direction, even if the driving part 300 has high torque using a driving motor 310 with a larger radius, the device may be manufactured to be slim.

Meanwhile, since the driving motor 310 is configured as a motor that is directly driven by minimizing intermediate mechanisms (gears, pulleys, reducers, and the like), such as a direct drive (DD) motor, it may generate high output power with higher torque and have a wide rotation range.

In particular, since the direct drive (DD) motors has a heavy weight, it may increase the weight of the exercise equipment 1000 to ensure that the body part 100 remains stable on the ground during use.

The bobbin 320 may be installed to be rotatable around the longitudinal bobbin shaft 325 such that one end 201 of the cable part 200 is wound therearound, and the exposed length of the cable part 200 exposed to the outside of the body part 100 may vary depending on the degree in which the cable part 200 is wound around the bobbin 320.

In other words, the bobbin 320 may be rotated by receiving rotational force generated from the driving motor 310 through the timing belt 330, which will be described later. In particular, if the bobbin 320 is rotated in a direction in which more of the cable part 200 is wound around the bobbin 320, the exposed portion of the cable part 200 may be pulled back into the accommodation space 101 of the body part 100.

The timing belt 330 may connect the driving motor 310 and the bobbin 320 to rotate the bobbin 320 by the rotational force of the driving motor 310, and may transmit the rotational force generated by the driving motor 310 to the bobbin 320 with some compensation depending on the rotation ratio between the driving motor 310 and the bobbin 320.

Specifically, as described above, in the case where the driving motor 310 is configured as a motor with high torque, such as a direct drive (DD) motor, if the driving motor 310 is directly connected to the cable part 200, the torque/rotation characteristics of the driving motor 310 may not be suitable for the load/pulling speed required for strength training.

That is, since the power generated from the driving motor 310 is high output with higher torque, if it is connected directly to the cable part 200, the exercise load may be very high and may be quickly provided to the cable part 200.

However, it may be desirable for the user using the exercise equipment 1000 that the exercise load is gradually applied in several stages in consideration of exercise efficiency.

Therefore, it may be desirable to separately configure the driving motor 310 and the bobbin 320, instead of directly connecting the driving motor 310 to the cable part 200 as described above, so that the driving motor 310 and the bobbin 320 are connected to the timing belt 330.

As described above, the exercise equipment 1000 according to an embodiment of the present disclosure separates the driving motor 310 and the bobbin 320 in the driving part 300 and connects them to the timing belt 330 according to the rotation ratio, configuring an optimal structure of the driving part 300 in consideration of both the torque/rotation characteristics of the driving motor 310 and the load/pulling speed required for strength exercise.

In addition, as described above, in order to manufacture the device with a slim thickness even though it has high torque, it may be desirable to separate the driving motor 310 and bobbin 320 in the driving part 300 to minimize the height of the driving motor 310.

In the exercise equipment 1000 according to an embodiment of the present disclosure, the body part 100 may be formed to be long along a first direction D1 on a plane, and the outlet 103 may be formed on the end portion in the first direction D1. In this case, the cable part 200 may be exposed to the outside of the body part 100 through the outlet 103.

Here, as shown in FIGS. 1 and 7, the first direction D1 may be a direction (left/light direction) parallel to the X direction, and a second direction D2 intersecting the first direction D1 may be a direction (front/back direction) parallel to the Y direction. In addition, the end portion in the first direction D1 may be a section extending to a predetermined length from the end of the body part 100 in the first direction D1.

The upper surface 104 of the body part 100 may be formed in a long plate shape along the first direction D1.

The length of the body part 100 in the first direction D1 may be determined in consideration of the shoulder width of the user, and the length of the body part 100 in the second direction D2 may be determined in consideration of the chest thickness of the user.

An outlet 103 may be formed on the end portion of the upper surface 104 of the body part 100 in the first direction D1, and the cable part 200 may be exposed through the outlet 103. Accordingly, the outlets 103 may be formed on both end portions of the body part 100 formed long in the first direction D1, and a pair of cable parts 200 may be exposed through the outlets 103.

Therefore, the user may perform an exercise of simultaneously pulling each cable part 200 by each arm, and this may be a common and preferred exercise type that may be performed using the exercise equipment 1000 according to the present embodiment.

As described above, in the exercise equipment 1000 according to an embodiment of the present disclosure, since the body part 100 is formed to be long in the first direction D1, and since the cable part 200 is installed to be exposed from the end portion of the body part 100 in the first direction D1, the user may effectively perform strength exercises using both arms while standing on the body part 100.

In the exercise equipment 1000 according to an embodiment of the present disclosure, the driving motor 310 is disposed inward from the outlet 103 in the first direction D1, and the bobbin 320 may be disposed from the driving motor 310 in the second direction D2 intersecting the first direction D1 on a plane.

Here, the inward position in the first direction D1 may be a position on the body part 100 in the first direction D1, which is not outside the outlet 103. That is, in the case where the first direction D1 is the left/right direction, the driving motor 310 is may be disposed on the right side of the outlet 103 on the left end portion, and the driving motor 310 may be disposed on the left side of the outlet 103 on the right end portion.

If both the driving motor 310 and the bobbin 320 are arranged on the line extending from the outlet 103 in the first direction D1, the length of the body part 100 in the first direction D1 may become too long.

In addition, if both the driving motor 310 and the bobbin 320 are disposed in the same Z direction, there may be a problem in which the thickness of the body part 100 must be increased by the combined thickness of the driving motor 310 and the bobbin 320.

Accordingly, the arrangement in which the driving motor 310 is disposed in the first direction D1 from the outlet 103 and in which the bobbin 320 is disposed in the second direction D2 from the driving motor 310 may solve all of the above problems.

As described above, in the exercise equipment 1000 according to an embodiment of the present disclosure, since the driving motor 310 is disposed inward from the outlet 103 in the first direction D1, and since the bobbin 320 is disposed in the second direction D2 intersecting the first direction D1, the driving motor 310 and the bobbin 320, which are separately disposed, may be appropriately disposed without overlapping each other on the plane.

In exercise equipment 1000 according to an embodiment of the present disclosure, the driving motor 310 may be disposed to have a larger area than the bobbin 320, and the bobbin 320 may be disposed lopsidedly from the outlet 103 with respect to the extension line along the first direction D1.

In order to install the driving motor 310 of high torque inside a limited accommodation space 101, a driving motor 310 with a larger radius needs to be installed. In this case, the bobbin 320 has a sufficient radius to change the torque of the driving motor 310 according to the rotation ratio, and does not need to have an excessively large radius.

Accordingly, the driving motor 310 and the bobbin 320 may be installed such that the driving motor 310 is to have a size capable of occupying a larger section than the bobbin 320 in the second direction D2.

As described above, in the exercise equipment 1000 according to an embodiment of the present disclosure, since the bobbin 320 is lopsidedly disposed from the outlet 103 with respect to the extension line along the first direction D1 so as to maximize the area of the driving motor 310, it is possible to secure a maximal space for arrangement of the driving motor 310.

In the exercise equipment 1000 according to an embodiment of the present disclosure, the driving part 300 may further include an articulation pulley 340 disposed on the end portion in the first direction D1 from the bobbin 320. In this case, the cable part 200 may extend from the bobbin 320 to the articulation pulley 340 in the first direction D1 and may be bent at the articulation pulley 340 to extend to the outlet 103.

As described above, in the case where the bobbin 320 is lopsidedly disposed, the direction of the cable part 200 extending from the bobbin 320 to the outlet 103 may not be parallel to the first direction D1 (X direction). That is, the cable part 200 may be disposed in a diagonal direction on the plane of the body part 100, which may cause interference with other components disposed in the accommodation space 101.

It is not desirable for the cable part 200 to be disposed in a diagonal direction on the plane of the body part 100 as described above, so it may be desirable for the cable part 200 to extend from the bobbin 320 to the articulation pulley 340 in the first direction D1 and then bend at the articulation pulley 340 toward the outlet 103.

As described above, in the exercise equipment 1000 according to an embodiment of the present disclosure, since the cable part 200 extending from the biased bobbin 320 in the first direction D1 is bent at the articulation pulley 340 and extends to the outlet 103, even if the bobbin 320 is lopsidedly disposed, the cable part 200 may extend without interference with other components.

In exercise equipment 1000 according to an embodiment of the present disclosure, the driving motor 310 may include a stator 311, a rotor 312, and a rotor sprocket 313. In particular, the driving motor 310 may have an outer rotor structure in which the stator 311 is formed relatively inward and the rotor 312 is formed relatively outward.

The stator 311 may be disposed outward from the motor shaft 315 in the circumferential direction thereof, and may generate magnetic flux when current flows through the coil structure.

The rotor 312 is positioned outward from the stator 311 in the circumferential direction thereof so as to be rotated by the stator 311, and is coupled to the motor shaft 315 to rotate together with the motor shaft 315. That is, the rotor 312 may generate magnetic flux in a magnet structure in which N and S poles are alternately arranged. In addition, the interaction between the magnetic flux generated in the stator 311 and the magnetic flux generated in the rotor 312 may rotate the rotor 312 together with the motor shaft 315, generating torque in the driving motor 310.

The outer rotor structure above has a larger rotation radius of the rotor 312 than the inner rotor structure, thereby generating a larger torque.

The rotor sprocket 313 is formed along the outer surface at the end of the motor shaft 315 to rotate together with the motor shaft 315, and a portion of the timing belt 330 is fastened thereto.

That is, when the motor shaft 315 rotates due to the rotation of the rotor 312, the rotor sprocket 313 formed at the end of the motor shaft 315 also rotates to transmit rotational force to the timing belt 330.

As described above, in the exercise equipment 1000 according to an embodiment of the present disclosure, since the driving motor 310 has an outer rotor structure, it is possible to install the driving motor 310 having a larger radius.

In exercise equipment 1000 according to an embodiment of the present disclosure, the driving motor 310 may further include an encoder magnet 316 and an encoder sensor 317.

The encoder magnet 316 is installed on the motor shaft 315 to rotate together with the motor shaft 315, and the encoder sensor 317 is disposed to be spaced apart from the motor shaft 315 to sense the rotation of the encoder magnet 316.

That is, when the motor shaft 315 rotates, the encoder magnet 316 installed on the motor shaft 315 also rotates, and a change in magnetic flux may be generated by the encoder magnet 316. In addition, such a change in magnetic flux may be sampled by the encoder sensor 317 and converted into an electric pulse, thereby detecting the position (amount of rotation) of the motor shaft 315.

As described above, since the exercise equipment 1000 according to an embodiment of the present disclosure recognizes the rotation amount of the driving motor 310 through the encoder magnet 316 and the encoder sensor 317, it is easier to control the driving motor 310.

In the exercise equipment 1000 according to an embodiment of the present disclosure, the bobbin 320 may include a bobbin body 321 and a bobbin sprocket 323.

The bobbin body 321 is formed along the outer surface of the bobbin shaft 325 to rotate together with the bobbin shaft 325, and the cable part 200 is wound around the same. That is, when the bobbin shaft 325 rotates, the bobbin body 321 rotates in the direction of winding or unwinding the cable part 200 so that the exposed length of the cable part 200 may vary.

The bobbin sprocket 323 is formed along the outer surface at the end of the bobbin shaft 325 to rotate together with the bobbin shaft 325, and another portion of the timing belt 330 is fastened thereto. That is, the rotational force transmitted from the driving motor 310 may rotate the bobbin sprocket 323 through the timing belt 330, and both the bobbin shaft 325 and the bobbin body 321 may rotate when the bobbin sprocket 323 rotates.

As described above, in the exercise equipment 1000 according to an embodiment of the present disclosure, since the bobbin body 321 around which the cable part 200 is wound and the bobbin sprocket 323 to which the timing belt 330 is fastened are formed separately, the stress applied by the cable part 200 and the stress applied by the timing belt 330 are distributed from each other in the bobbin 320, thereby reducing mechanical stress.

In the exercise equipment 1000 according to an embodiment of the present disclosure, the cable part 200 may be wound according to sequential heights between the bottom and top of the bobbin body 321. Here, the sequential height may be the height from the bottom of the bobbin body 321 to the top, the height from the top of the bobbin body 321 to the bottom, or the height from the center of the bobbin body 321 to the top or bottom.

Specifically, as shown in FIG. 8C, the bobbin body 321 may be formed to have a cylindrical outer surface, and this outer surface may be a winding surface on which the cable part 200 is wound.

In this case, since the maximum exposed length of the cable part 200 is proportional to the cylindrical area of the cylindrical winding surface of the bobbin body 321, it may be advantageous to secure the maximum height of the bobbin body 321.

However, considering the characteristics of the exercise equipment 1000, since there is a limit to the size and height of the accommodation space 101 of the body part 100, the cylindrical radius and height of the bobbin body 321 may be selected appropriately maximally using the accommodation space 101.

Therefore, considering the specifications of the bobbin body 321 selected above, in order to secure a longer exposed length of the cable part 200, the cable part 200 needs to be wound according to sequential heights between the bottom and top of the bobbin body 321 such that the wound cable parts 200 do not interfere with each other.

As described above, in the exercise equipment 1000 according to an embodiment of the present disclosure, since the cable part 200 is wound according to the sequential heights between the bottom and top of the bobbin body 321, it is possible to maintain a stable winding state while securing a long length of the cable part 200 wound around the bobbin 320.

In exercise equipment 1000 according to an embodiment of the present disclosure, a plurality of cable parts 200 may be provided in the body part 100, and the driving part 300 may be installed to each cable part 200.

In this regard, the user using the exercise equipment 1000 according to the present embodiment may wish to perform an exercise in more diverse ways for more diverse parts of body.

Accordingly, a plurality of cable parts 200 may be disposed in the body part 100 to enable the user to perform an exercise using both arms at the same time or using arms and legs at the same time. Alternatively, it may be desirable to have a plurality of cable parts 200 disposed in the body part 100 so that several people may use one exercise equipment 1000 at the same time.

Meanwhile, in the case where a plurality of cable parts 200 are provided in the body part 100 as described above, the arrangement of the driving parts 300 coupled to provide an exercise load to the cable parts 200 may be an important consideration.

If a plurality of cable parts 200 are coupled to one driving part 300, it is necessary to install a separate differential or the like so that the exercise load provided from the driving part 300 is transferred to the respective cable parts 200.

However, this structure may generate noise and vibration due to transmission of gears inside the differential, so that the user using the exercise equipment 1000 may have a non-smooth and heterogeneous feeling of pulling the cable parts 200. In addition, this structure may bring about mechanical/signal interference between the driving part 300 and each cable part 200, making it difficult to precisely detect or control the exposed length of each cable part 200.

Therefore, the exercise equipment 1000 according to the present embodiment is structured in such a way that one cable part 200 is coupled to one driving part 300 to minimize noise and vibration and provide an efficient exercise load. In addition, as many driving parts 300 as the cable parts 200 are allocated to minimize mechanical/signal interference with each other, enabling precise detection and control.

In addition, since as many driving part 300 as the cable parts 200 may be repeatedly provided as the same component, costs may be reduced when manufacturing the exercise equipment 1000.

As described above, in the exercise equipment 1000 according to an embodiment of the present disclosure, since a plurality of cable parts 200 are disposed in the body part 100, and since the driving part 300 for providing an exercise load is installed in each cable part 200, it is possible to precisely sense and control the exposed length of each of the plurality of cable parts 200, and the feeling of pulling the cable may be improved, thereby improving the usability of the device.

The exercise equipment 1000 according to an embodiment of the present disclosure may further include a controller 400 that is disposed in the space formed between the respective driving parts 300 in the accommodation space 101 and controls the driving parts 300.

Specifically, the controller 400 may be connected to respective elements constituting the exercise equipment 1000 so as to control the operation of each element.

For control of the controller 400, the exercise equipment 1000 may be equipped with a storage medium in which an application program is stored. In addition, the controller 400 may be configured to execute an application program according to information input to the exercise equipment 1000 and information output from the exercise equipment 1000, thereby controlling the exercise equipment 1000.

In this case, the controller 400 may perform control such that the respective driving parts 300 that provide the exercise load operate independently. That is, the controller 400 may control the respective driving parts 300 to operate in different states from each other, and may perform control such that the exercise load provided by one driving part 300 is not related to the exercise load provided by another driving part 300.

In this case, although the exercise equipment 1000 may be used in various ways, it may not be effective when the user using the exercise equipment 1000 performs exercises for multiple body parts.

For example, as shown in FIGS. 3 and 4, in the case where the user performs exercise using both arms simultaneously, the user may wish to obtain the exercise effect as if lifting a single barbell, while the exercise loads applied to the respective arms are linked to each other.

However, if the respective driving parts 300 are controlled independently, the user may feel as if he or she is lifting different barbells by different arms, which may not meet the user's intention.

In addition, in the case where the user performs exercise using both arms at the same time, the arm with strong strength may be distinguished from the arm with weak strength, so it may be desirable to provide exercise loads linked to each other to the respective arms in consideration of the strength of the arms.

Accordingly, the controller 400 may control the driving parts 300 such that the respective driving parts 300 operate in conjunction with each other.

As described above, in the exercise equipment 1000 according to an embodiment of the present disclosure, since the respective driving parts 300 that provide exercise loads to the respective cable parts 200 are controlled in conjunction with each other by the controller 400, the user may efficiently perform strength training, as well as various exercise modes through the device.

In the exercise equipment 1000 according to an embodiment of the present disclosure, a pair of the driving parts 300 may be disposed to be symmetrical on both sides of the first direction D1. Here, when referring to FIGS. 5 and 6, a pair of driving parts 300 may be arranged in a point-symmetrical structure with respect to the center point C on the plane of the body part 100.

As described above, in the case where the cable parts 200 are pulled from both end portions of the upper surface 104 of the body part 100, it may be desirable for the exercise load transfer structure that the respective driving parts 300 coupled to the respective cable parts 200 are distributed and disposed on both sides of the body part 100, instead of being concentrated on a specific portion of the body part 100.

In addition, since the body part 100 is required to be stably maintained on the ground when the user uses the exercise equipment 1000, it is desirable that the weight of the exercise equipment 1000 is evenly distributed overall.

In particular, since the driving part 300 has a relatively heavy weight, compared to other components, due to its structural characteristics for providing exercise loads, the driving part 300 needs to be disposed in a balanced manner in the accommodation space 101 of the body part 100, instead of being concentrated on a specific portion.

Therefore, as shown in FIGS. 5 and 6, it may be desirable to arrange a pair of driving parts 300 to be point-symmetrical on both sides of the first direction D1 in the accommodation space 101.

As described above, in the exercise equipment 1000 according to an embodiment of the present disclosure, since a pair of driving parts 300 are disposed to be point-symmetrical on both sides of the body part 100 in the first direction D1, the overall weight of the device may be distributed stably without being lopsided while easily providing exercise loads to the respective cable parts 200.

In the exercise equipment 1000 according to an embodiment of the present disclosure, the controller 400 may be disposed between a pair of driving parts 300.

As described above, in the case where the respective driving parts 300 are distributed and arranged on both sides of the body part 100, it may be desirable for the control signal transmission structure that the controller 400 connected to the respective driving parts 300 is disposed in the central portion of the body part 100 (the portion between the driving parts 300).

In addition, the central portion of the body part 100 (the portion between the driving parts 300) is spatially more spacious in the case where the respective driving parts 300 are distributed and arranged on both sides of the body part 100, so it may be desirable to place various electronic/control/heat dissipation parts, including the controller 400, in the central portion of the body part 100 (the portion between the driving parts 300).

As described above, in the exercise equipment 1000 according to an embodiment of the present disclosure, since the controller 400 is disposed in the space formed between the driving parts 300 in the accommodation space 101, the controller 400 may be effectively connected to the driving parts 300, and space efficiency for the accommodation space 101 may be maximized.

Figure 9:
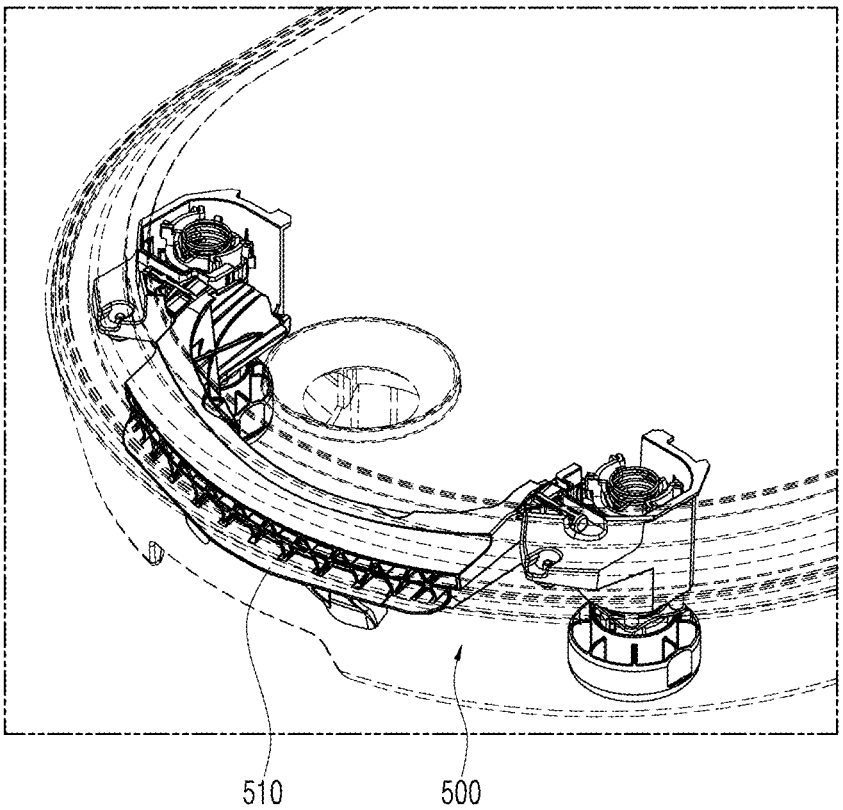
FIG. 9 is a diagram illustrating a caster in exercise equipment according to an embodiment of the present disclosure.
Figure 10:
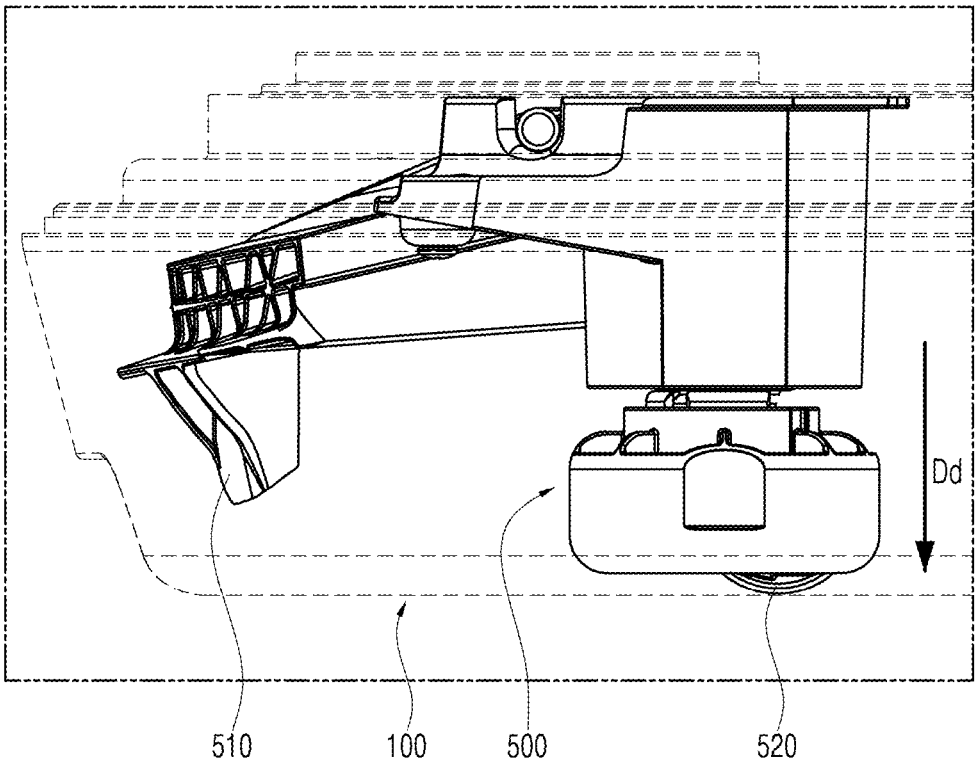
FIGS. 10 and 11 are diagrams illustrating the state in which the caster shown in FIG. 9 is moved.
Figure 11:
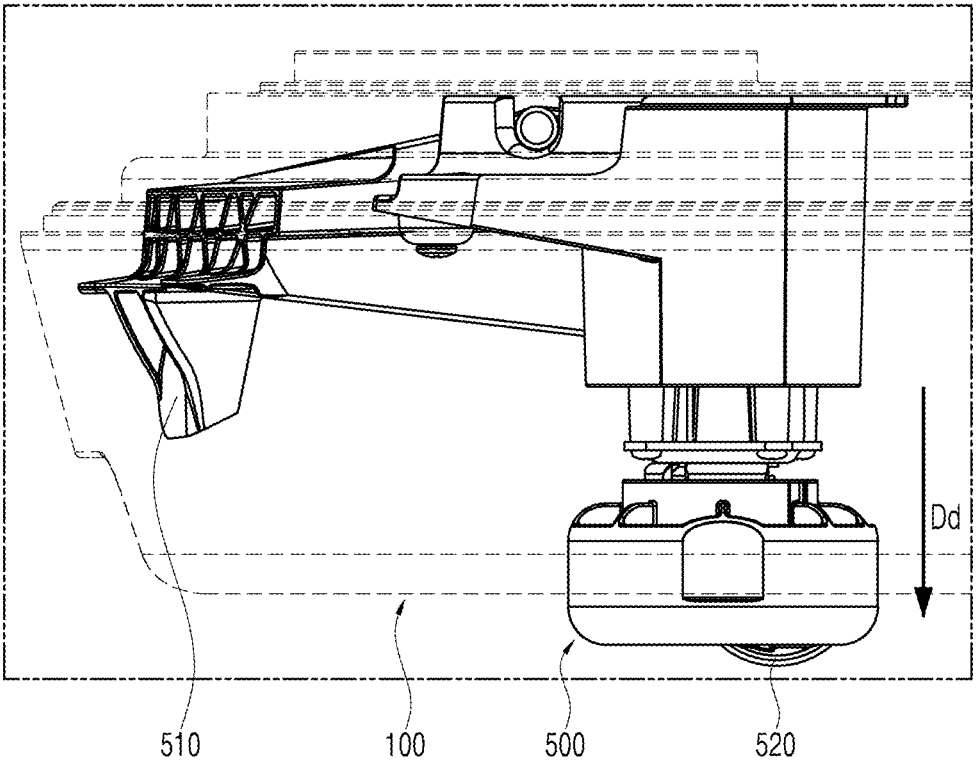

FIG. 9 is a diagram illustrating a caster 500 in exercise equipment 1000 according to an embodiment of the present disclosure. FIGS. 10 and 11 are diagrams illustrating the state in which the caster 500 shown in FIG. 9 is moved.

The exercise equipment 1000 according to an embodiment of the present disclosure may further include a caster 500 that protrudes from the body part 100 in a downward direction Dd and is capable of rolling on the ground.

As mentioned above, although it is desirable to stably maintain the body part 100 seated on the ground during using the exercise equipment 1000 having a larger weight, the heavy weight may make it difficult to move the exercise equipment 1000 by the user.

Accordingly, a caster 500 may be installed to protrude in the downward direction Dd from the body part 100, so that the user may move the exercise equipment 1000 by rolling without lifting the same when movement is necessary.

In this case, as shown in FIG. 2, four casters 500 may be arranged along the outer portion of the lower surface 105 of the body part 100, but they are not necessarily limited thereto, and the arrangement and number of casters 500 may vary as necessary.

In addition, the caster 500 may be configured to rotate 360 degrees on a plane in contact with the ground, thereby moving in all directions on the plane by the rolling movement of the casters 500. In addition, the caster 500 may be configured to include a suspension structure to absorb vibration due to ground irregularities when rolling on the ground.

As described above, since the exercise equipment 1000 according to an embodiment of the present disclosure moves by rolling on the ground through the casters 500 protruding from the body part 100 in the downward direction Dd, the user may use the device while easily moving the same as needed.

In the exercise equipment 1000 according to an embodiment of the present disclosure, the caster 500 may be installed to move in the vertical direction with respect to the body part 100 such that it protrudes or does not protrude from the body part 100.

As described above, when the exercise equipment 1000 is required to be moved, it may be advantageous for the caster 500, which protrudes in the downward direction Dd from the body part 100, to come into contact with and roll on the ground.

On the other hand, since the body part 100 needs to be stably maintained on the ground when using the exercise equipment 1000, it may be disadvantageous for the caster 500 to be in contact with and roll on the ground. Therefore, during use of the exercise equipment 1000, it is necessary to store the caster 500 inside the body part 100 so that the caster 500 does not come into contact with the ground.

Specifically, as shown in FIGS. 10 and 11, the caster 500 may move in the vertical direction with respect to the body part 100.

Therefore, when the caster 500 is requited not to be in contact with the ground, the caster 500 may rise as shown in FIG. 10 such that the caster wheel 520 does not protrude out of the body part 100.

On the other hand, when the caster 500 is requited to be in contact with the ground, the caster 500 may descend as shown in FIG. 11 such that the caster wheel 520 may protrude to the outside of the body part 100.

In this case, the caster 500 may include a caster lever 510 that controls the up and down movement, and the user may control the up and down movement of the caster 500 by manipulating the caster lever 510.

As described above, in the exercise equipment 1000 according to an embodiment of the present disclosure, the protrusion of the caster 500 changes with respect to the body part 100 by moving the caster 500 up and down, so that the device may be stably supported on the ground when the device is required to be stationary, for example, when the user is doing strength training.

Figure 12:
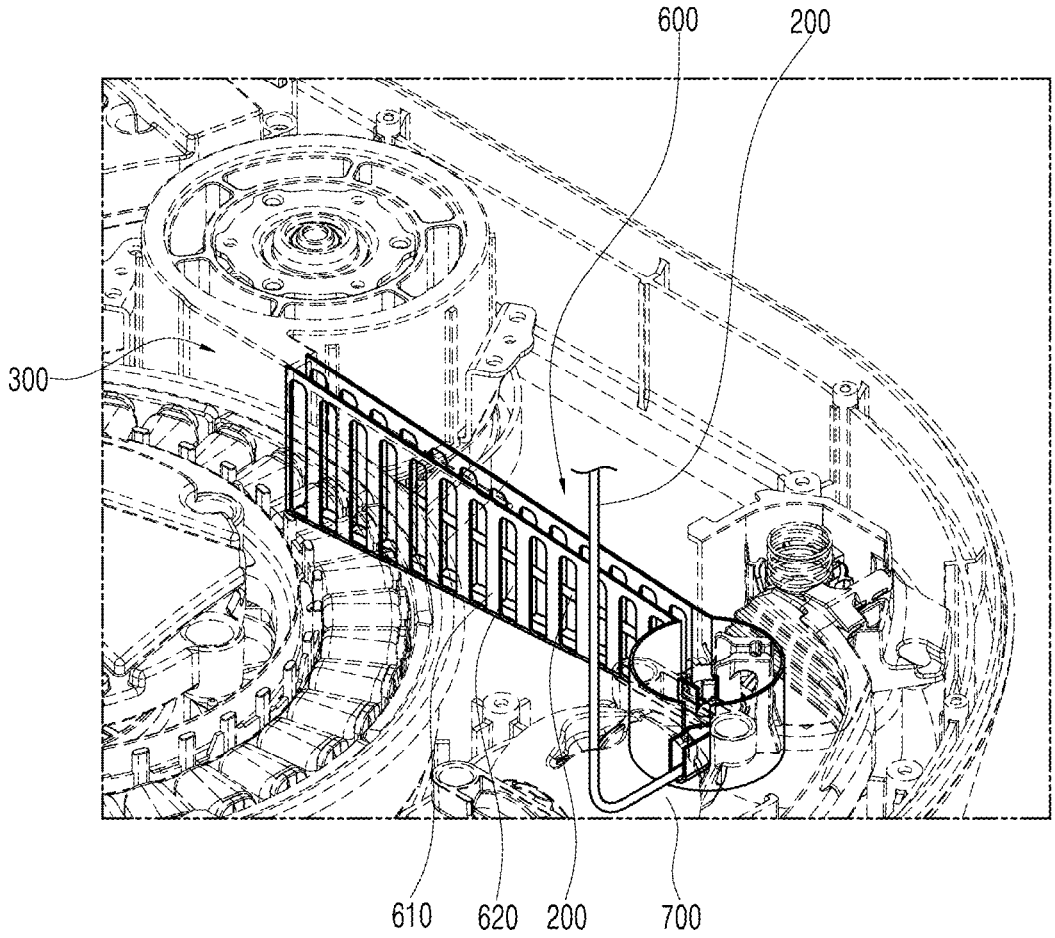
FIG. 12 is a diagram illustrating a guide wall in exercise equipment according to an embodiment of the present disclosure.

FIG. 12 is a diagram illustrating a guide wall 600 in exercise equipment 1000 according to an embodiment of the present disclosure.

The exercise equipment 1000 according to an embodiment of the present disclosure may further include a guide wall 600 that guides the extension section of the cable part 200 extending between the driving part 300 and the outlet 103.

As shown in FIG. 12, there may be an extension section of the cable part 200 of a considerable length, which extends from the driving part 300 to the outlet 103, in the accommodation space 101 of the body part 100. In this section, the cable part 200 may be excessively loosened for various unintentional reasons.

In particular, the cable, wire, rope, or belt constituting the cable part 200 may have a certain degree of rigidity against tensile force along the longitudinal direction, but may not be able to prevent deformation against other external forces at all.

Accordingly, the cable part 200 may be unintentionally deformed in the section between the driving part 300 and the outlet 103 and come into contact with nearby components, thereby interfering with primary components.

In the event of such interference, it may not be easy to pull the cable part 200, and the functions of nearby components may deteriorate, so it is necessary to prevent the cable part 200 from being deformed into an unintended state by installing the guide wall 600 in the section between the driving part 300 and the outlet 103.

In this case, the guide wall 600 may support at least one side of the cable part 200 in the longitudinal direction and prevent the cable part 200 from being deformed in a direction other than the longitudinal direction on the plane.

As described above, in the exercise equipment 1000 according to an embodiment of the present disclosure, since the guide wall 600 is installed between the driving part 300 and the outlet 103 to guide the cable part 200 in the corresponding section, it is possible to prevent the cable part 200 from deviating from the designed trajectory and avoid interference with other adjacent components.

In the exercise equipment 1000 according to an embodiment of the present disclosure, the guide wall 600 may include a guide wall body 610 and a guide hole 620.

The guide wall body 610 may be formed to extend in part or all of the section between the driving part 300 and the outlet 103 to restrict the cable part 200 from moving in a direction other than the longitudinal direction, and may be configured to support at least one side of the cable part 200 in the longitudinal direction.

A plurality of guide holes 620 may be formed intermittently along the longitudinal direction of the guide wall body 610 to have a shape perforating the guide wall body 610, so the airflow hitting the guide wall body 610 may pass through the guide wall body 610 through the guide holes 620.

As described above, the guide wall body 610 needs to be formed to extend between the driving part 300 and the outlet 103. In addition, since the cable part 200 is wound from the bottom to the top of the bobbin body 321, the guide wall body 610 also needs to be formed to a height corresponding to the height of the bobbin body 321.

Accordingly, the guide wall body 610, which restricts the cable part 200 from moving in a direction other than the longitudinal direction, may be formed as a wall structure with a considerable length and height, but the airflow for cooling the nearby driving motor 310 may be blocked by the guide wall body 610.

Therefore, it is desirable that the guide wall 600 is configured to have the guide hole 620 formed on the guide wall body 610 to protect the trajectory of the cable part 200 and secure the airflow necessary for cooling the driving motor 310 or the like.

As described above, in the exercise equipment 1000 according to an embodiment of the present disclosure, since a plurality of guide holes 620 are formed in a shape perforating the guide wall body 610 among the detailed configuration of the guide wall 600, it is possible to prevent the airflow from being blocked by the guide wall 600 in the accommodation space 101.

Figure 13:
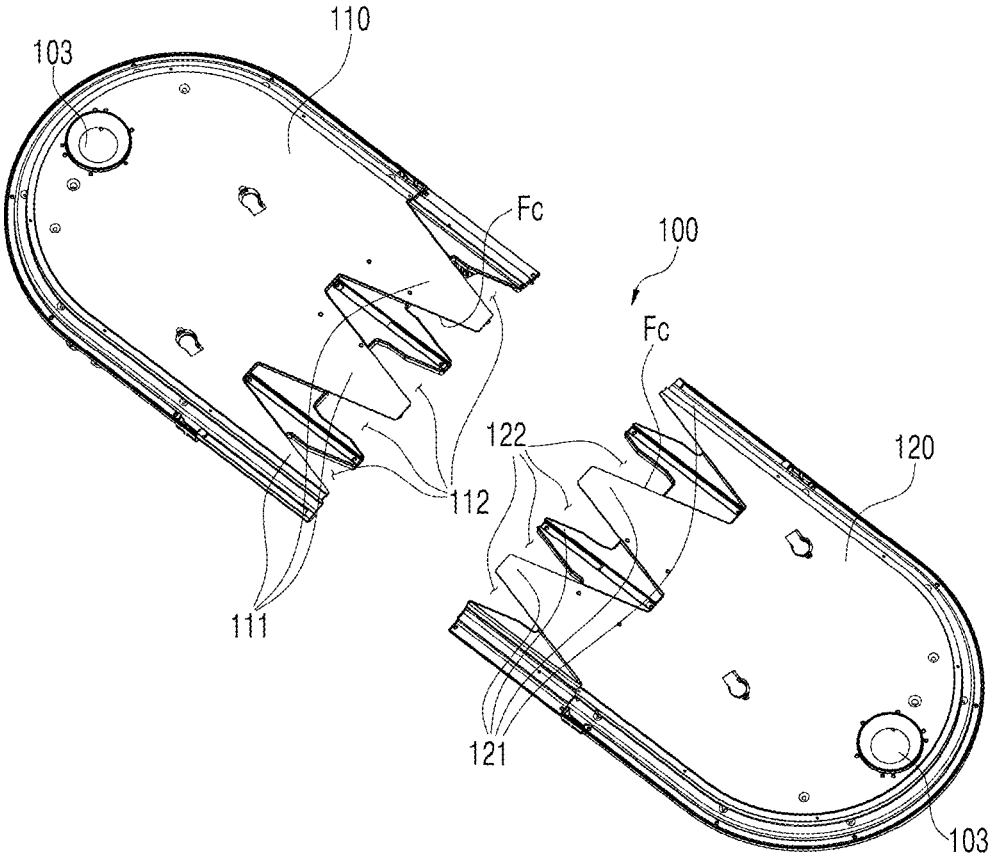
FIG. 13 is a diagram illustrating an example in which a body part is manufactured to be divided into a plurality of parts in exercise equipment according to an embodiment of the present disclosure.
Figure 14:
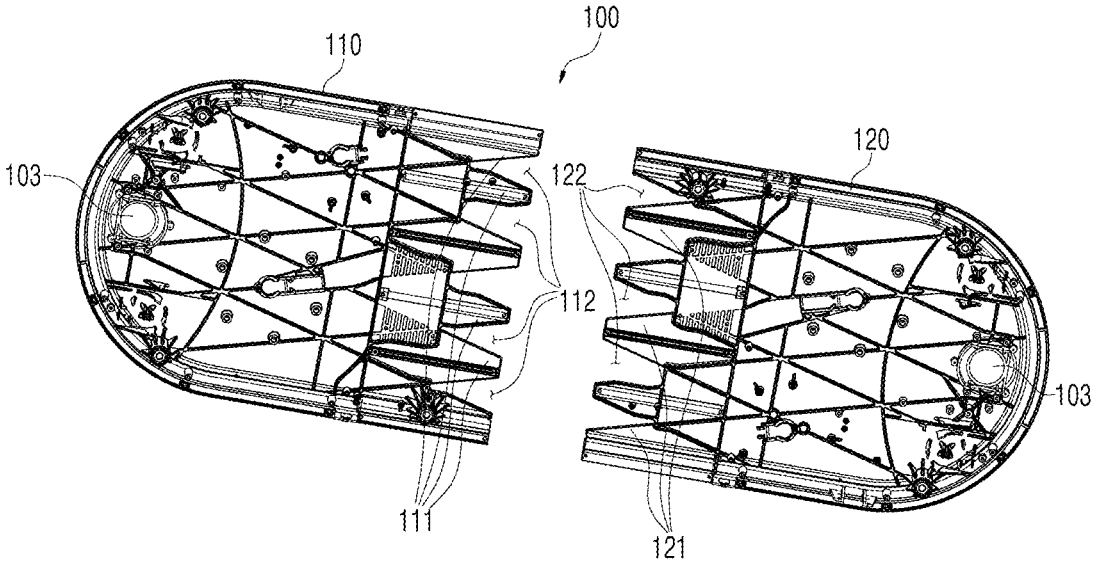
FIG. 14 is a diagram illustrating the body part in FIG. 13 viewed from another direction.
Figure 15:
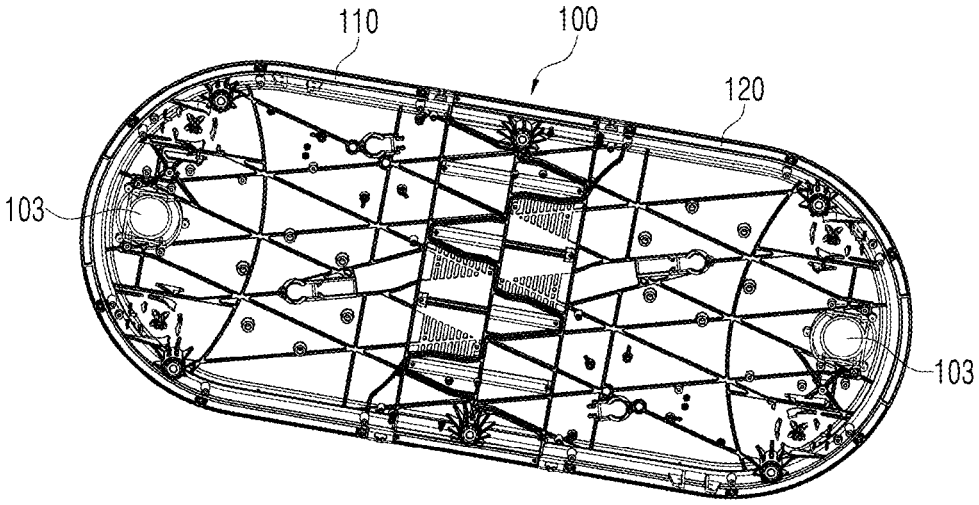
FIG. 15 is a diagram illustrating the assembled state of the body part shown in FIG. 14.
Figure 16:
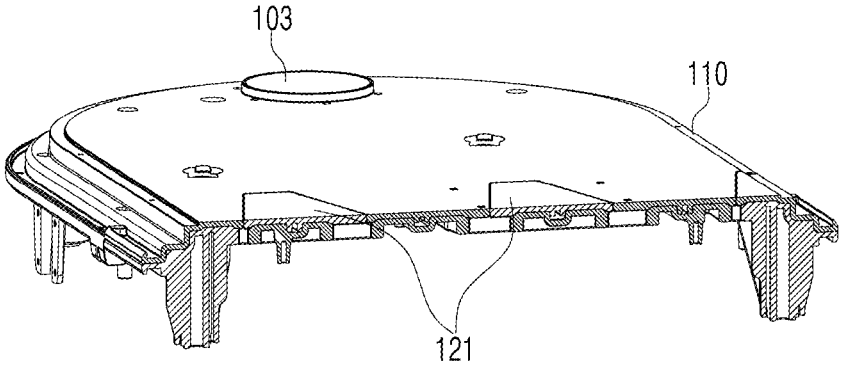
FIG. 16 is a diagram illustrating a cross-section of the assembly surface of the body part shown in FIG. 15.

FIG. 13 is a diagram illustrating an example in which a body part 100 is manufactured to be divided into a plurality of parts in exercise equipment 1000 according to an embodiment of the present disclosure. FIG. 14 is a diagram illustrating the body part 100 in FIG. 13 viewed from another direction. FIG. 15 is a diagram illustrating the assembled state of the body part 100 shown in FIG. 14. FIG. 16 is a diagram illustrating a cross-section of the assembly surface of the body part 100 shown in FIG. 15.

In the exercise equipment 1000 according to an embodiment of the present disclosure, the body part 100 may include a first body 110 and a second body 120.

The first body 110 constitutes part of the body part 100, and the second body 120 constitutes the remaining part of the body part 100 and may be assembled with the first body 110. That is, the body part 100 may be manufactured by assembling a plurality of manufactured parts.

Depending on the type of exercise equipment 1000 according to the present embodiment, it may be difficult to manufacture the body part 100 as one piece in the case where the body part 100 is too large or has a complicated shape.

In this case, as shown in FIGS. 13 and 14, the body part 100 may be manufactured to be divided into the first body 110 and the second body 120, which are capable of being manufactured as one piece. Then, as shown in FIGS. 15 and 16, the first body 110 and the second body 120, which are manufactured as one piece, may be assembled, completing the body part 100.

As described above, since the exercise equipment 1000 according to an embodiment of the present disclosure includes a first body 110 and a second body 120 that are manufactured separately from each other and assembled to the body part 100, the body part 100 may be configured by assembling a plurality of parts that are separately manufactured in the case of specifications or structures that are difficult to manufacture the body part 100 as one piece.

In the exercise equipment 1000 according to an embodiment of the present disclosure, concavo-convex surfaces Fc are formed in the assembled portions of the first body 110 and the second body 120 to correspond to each other, so that the concavo-convex surfaces Fc may engage with each other when assembling the first body 110 and the second body 120.

Specifically, the first body 110 may have first convex portions 111 and first concave portions 112 formed alternately in the portion to be assembled. In addition, the second body 120 may have second convex portions 121 and second concave portions 122, corresponding to the first convex portions 111 and the first concave portions 112, formed alternately in the portion to be assembled.

In this case, the first convex portions 111 and the first concave portions 112 may be formed alternately on the plane of the first body 110 and may also be formed as a plurality of layers in the cross-section. In addition, the second convex portions 121 and second concave portions 122 may be formed alternately on the plane of the second body 120 and may also be formed as a plurality of layers in the cross-section.

Accordingly, when assembling the first body 110 and the second body 120, a three-dimensional zigzag assembly surface may be implemented in the planar direction and the cross-sectional direction, and this assembly surface structure may strengthen the joint rigidity of the first body 110 and the second body 120.

As described above, since the exercise equipment 1000 according to an embodiment of the present disclosure has the concavo-convex surfaces Fc formed on the first body 110 and the second body 120, which correspond to each other and are assembled to engage each other, it is possible to strengthen the joint rigidity on the assembly surface, thereby preventing the durability of the assembled device from deteriorating.

Meanwhile, the assembly surfaces of the first body 110 and the second body 120 do not necessarily have to have a zigzag structure as described above, and may be formed in a simple boundary structure or a welded joint as necessary.

In the exercise equipment 1000 according to an embodiment of the present disclosure, the first body 110 and the second body 120 may be formed in shapes that are symmetrical to each other.

In the case of the structure separately manufactured and then assembled as described above, it may be advantageous for cost-effectiveness and production efficiency to manufacture the first body 110 and the second body 120 in the same shape, instead of separately manufacturing the first body 110 and the second body 120.

To this end, the first body 110 and the second body 120 may be formed symmetrically, so that the first body 110 may be used as the second body 120 or the second body 120 may be used as the first body 110 without being limited to the directionality.

As described above, in the exercise equipment 1000 according to an embodiment of the present disclosure, since the first body 110 and the second body 120 are formed symmetrically, it is possible to improve production efficiency by manufacturing a plurality of parts of the same shape and then assembling the same.

The exercise equipment 1000 according to an embodiment of the present disclosure may further include an outlet part 700 that is installed in the outlet 103 such that the cable part 200 passes therethrough and configured to buffer pressure due to changes in the pulling trajectory of the cable part 200.

That is, the outlet part 700 may be formed in a shape to cover the outlet 103 formed on the body part 100. The outlet part 700 may be configured to allow the cable part 200 to pass therethrough upward from the bottom, so that the cable part 200 extending from the inside of the body part 100 may be exposed to the outside of the body part 100 by passing through the outlet part 700.

Accordingly, contact of the cable part 200 exposed to the outside of the body part 100 with components other than the outlet part 700 may be minimized, thereby preventing unintentional damage to the same.

In this case, the outlet part 700 may be configured not to constrain the pulling trajectory of the cable part 200 in the 360-degree directions on the plane of the body part 100, so that the trajectory of the exposed cable part 200 may vary in various directions. To this end, the outlet part 700 may include at least one shaft rotation structure and/or at least one pulley structure.

As described above, in the exercise equipment 1000 according to an embodiment of the present disclosure, since the cable part 200 extends by passing through the outlet part 700 installed in the outlet 103 such that the pulling trajectory of the cable part 200 changes, even if the pulling trajectory of the cable part 200 changes in various directions depending on the state of strength exercise, the cable may be smoothly pulled without damage to the device.

In the exercise equipment 1000 according to an embodiment of the present disclosure, the cable part 200 may include a cable stopper 210 provided at the other end of the cable part 200 so as to be stopped when the pulled length of the cable part is reduced.

As described above, the other end 202 of the cable part 200 needs to be exposed to the outside of the body part 100. However, if the exercise load provided from the driving part 300 is greater than the external force applied by the user, the cable part 200 may retract into the accommodation space 101 so that the exposed length of the cable part 200 may be shortened.

In particular, if the cable part 200 suddenly retracts into the accommodation space 101, such as when the external force is momentarily removed, there will be no cable part 200 exposed to the outside of the body part 100, so that the user is unable to perform an exercise.

Therefore, even when the cable part 200 retracts into the accommodation space 101 due to the exercise load, a cable stopper 210 needs to be provided at the other end of the cable part 200 to maintain the minimum exposed length of the cable part 200.

As described above, in the exercise equipment 1000 according to an embodiment of the present disclosure, since the minimum exposed length of the cable part 200 is maintained by the cable stopper 210 formed on the cable part 200, it is possible to prevent the entire cable part 200 from retracting into the body part 100 when the external force is eliminated.

The exercise equipment 1000 according to an embodiment of the present disclosure may further include a handle 800 that is coupled to the other end 202 of the cable part 200 so as to be gripped by the user to apply external force.

In this case, the cable part 200 may further include a handle connector 220 formed on the other end such that the handle 800 is detachably coupled thereto.

For exercise, although the user may directly hold the other end 202 of the cable part 200, it may be inconvenient for the user to directly hold the other end 202 of the cable part 200 due to the shape of the cable part 200.

In addition, various modes of exercise may be performed, depending on the type of exercise the user intends, such as an exercise in which respective arms need to move separately or an exercise in which both arms need to move together.

Therefore, in order to implement exercises that the user wishes, the handle 800 in a specific shape may be coupled to the handle connector 220 provided at the other end of the cable part 200 so that the user may perform the exercise while holding the handle 800.

In this case, although FIGS. 3 and 4 show that the handle 800 is configured as a rod, the handle 800 may be modified in various ways, such as a pair of separate handles.

As described above, in the exercise equipment 1000 according to an embodiment of the present disclosure, since the strength exercise is performed by the user holding the handle 800 coupled to the handle connector 220 formed on the cable part 200, the user may use the device more easily and in various exercise modes.

Although specific embodiments of the present disclosure have been described and shown above, the present disclosure is not limited to the described embodiments, and it is obvious to those skilled in the art to which the present disclosure pertains that various modifications and variations may be made without departing from the spirit and scope of the present disclosure. Accordingly, such modifications or variations should not be understood independently from the technical idea or perspective of the present disclosure, and the modified embodiments should be considered to fall within the scope of the claims of the present disclosure.

INDUSTRIAL APPLICABILITY

According to at least one of the embodiments of the present disclosure, since the driving motor used in the driving part has a structure capable of generating rotational force around the motor shaft in the longitudinal direction, even if the driving part has high torque using a driving motor with a larger radius, the device may be manufactured to be slim.

In addition, according to at least one of the embodiments of the present disclosure, since the driving part is configured in a structure in which the driving motor and the bobbin are separated and connected through the timing belt according to the rotation ratio in the driving part, it is possible to configure an optimal structure of the driving part in consideration of both the torque/rotation characteristics of the driving motor and the load/pulling speed required for strength exercise.

In addition, according to at least one of the embodiments of the present disclosure, since the body part is formed to be long in the first direction, and since the cable part is installed to be exposed from the end portion of the body part in the first direction, the user may effectively perform strength exercises using both arms while standing on the body part.

In addition, according to at least one of the embodiments of the present disclosure, since the driving motor is disposed inward from the outlet in the first direction, and since the bobbin is disposed in the second direction intersecting the first direction, the driving motor and the bobbin, which are separately disposed, may be appropriately disposed without overlapping each other on the plane.

In addition, according to at least one of the embodiments of the present disclosure, since the bobbin is lopsidedly disposed from the outlet with respect to the extension line along the first direction so as to maximize the area of the driving motor, it is possible to secure a maximal space for arrangement of the driving motor.

In addition, according to at least one of the embodiments of the present disclosure, since the cable part extending from the biased bobbin in the first direction is bent at the articulation pulley and extends to the outlet, even if the bobbin is lopsidedly disposed, the cable part may extend without interference with other components.

In addition, according to at least one of the embodiments in the present disclosure, since the driving motor has an outer rotor structure, a driving motor with a larger radius may be installed.

In addition, according to at least one of the embodiments in the present disclosure, since the rotation amount of the driving motor is detected through the encoder magnet and the encoder sensor, the driving motor may be controlled more easily.

In addition, according to at least one of the embodiments of the present disclosure, since the bobbin body around which the cable part is wound and the bobbin sprocket to which the timing belt is fastened are formed separately, the stress applied by the cable part and the stress applied by the timing belt are distributed from each other in the bobbin, thereby reducing mechanical stress.

In addition, according to at least one of the embodiments in the present disclosure, since the cable part is wound according to the sequential heights between the bottom and top of the bobbin body, it is possible to maintain a stable winding state while securing a long length of the cable part wound around the bobbin.

In addition, according to at least one of the embodiments of the present disclosure, since a plurality of cable parts are disposed in the body part, and since the driving part for providing an exercise load is installed in each cable part, it is possible to precisely sense and control the exposed length of each of the plurality of cable parts, and the feeling of pulling the cable may be improved, thereby improving the usability of the device.

In addition, according to at least one of the embodiments of the present disclosure, since the controller is disposed in the space formed between the driving parts in the accommodation space, the controller may be effectively connected to the driving parts, and space efficiency for the accommodation space may be maximized.

In addition, according to at least one of the embodiments in the present disclosure, since the exercise equipment moves by rolling on the ground through the casters protruding from the body part in the downward direction, the user may use the device while easily moving the same as needed.

In addition, according to at least one of the embodiments in the present disclosure, since the protrusion of the caster changes with respect to the body part by moving the caster up and down, the device may be stably supported on the ground when the device is required to be stationary, for example, when the user is doing strength training.

In addition, according to at least one of the embodiments of the present disclosure, since the guide wall is installed between the driving part and the outlet to guide the cable part in the corresponding section, it is possible to prevent the cable part from deviating from the designed trajectory and avoid interference with other adjacent components.

In addition, according to at least one of the embodiments of the present disclosure, since a plurality of guide holes are formed in a shape perforating the guide wall body among the detailed configuration of the guide wall, it is possible to prevent the airflow from being blocked by the guide wall in the accommodation space.

In addition, according to at least one of the embodiments of the present disclosure, since the body part includes a first body and a second body that are manufactured separately from each other and assembled, the body part may be configured by assembling a plurality of parts that are separately manufactured in the case of specifications or structures that are difficult to manufacture the body part as one piece.

In addition, according to at least one of the embodiments of the present disclosure, since the concavo-convex surfaces are formed on the first body and the second body, which correspond to each other and are assembled to engage each other, it is possible to strengthen the joint rigidity on the assembly surface, thereby preventing the durability of the assembled device from deteriorating.

In addition, according to at least one of the embodiments of the present disclosure, since the first body and the second body are formed symmetrically, it is possible to improve production efficiency by manufacturing a plurality of parts of the same shape and then assembling the same.

In addition, according to at least one of the embodiments of the present disclosure, since the cable part extends by passing through the outlet part installed in the outlet such that the pulling trajectory of the cable part changes, even if the pulling trajectory of the cable part changes in various directions depending on the state of strength exercise, the cable may be smoothly pulled without damage to the device.

In addition, according to at least one of the embodiments of the present disclosure, since the minimum exposed length of the cable part is maintained by the cable stopper formed on the cable part, it is possible to prevent the entire cable part from retracting into the body part when the external force is eliminated.

In addition, according to at least one of the embodiments of the present disclosure, since the strength exercise is performed by the user holding the handle coupled to the handle connector formed on the cable part, the user may use the device more easily and in various exercise modes.

The invention claimed is:

1. Exercise equipment comprising:

a body part having an accommodation space formed therein and an upper surface formed in a plate shape;

a cable part having one end coupled to the accommodation space and the other end exposed to the outside through an outlet of the body part, and configured to change an exposed length thereof by external force; and a driving part coupled to one end of the cable part in the accommodation space and configured to provide the cable part with an exercise load to resist the external force, wherein the driving part comprises:

a driving motor configured to generate rotational force around a motor shaft in the longitudinal direction;

a bobbin installed to rotate around a bobbin shaft in the longitudinal direction and configured to wind one end of the cable part; and a timing belt configured to connect the driving motor and the bobbin, and rotate the bobbin using the rotational force of the driving motor.

2. The exercise equipment according to claim 1, wherein the body part is formed to be long in a first direction on a plane so that the outlet is formed at an end portion in the first direction, and wherein the cable part is exposed to the outside of the body part through the outlet.

3. The exercise equipment according to claim 2, wherein the driving motor is disposed inward from the outlet in the first direction, and wherein the bobbin is disposed in a second direction intersecting the first direction on a plane from the driving motor.

4. The exercise equipment according to claim 3, wherein the driving motor is disposed to have a larger area than the bobbin, and wherein the bobbin is lopsidedly disposed on one side, based on an extension line from the outlet along the first direction.

5. The exercise equipment according to claim 4, wherein the driving part further comprises an articulation pulley disposed on an end portion of the first direction from the bobbin, and wherein the cable part extends from the bobbin to the articulation pulley along the first direction and is bent at the articulation pulley to extend to the outlet.

6. The exercise equipment according to claim 1, wherein the driving motor comprises:

a stator disposed outward from the motor shaft in the circumferential direction thereof;

a rotor positioned outward from the stator in the circumferential direction to be rotated by the stator, and coupled to the motor shaft to rotate together with the motor shaft; and a rotor sprocket formed along the outer surface at the end of the motor shaft to rotate together with the motor shaft such that a portion of the timing belt is fastened thereto.

7. The exercise equipment according to claim 6, wherein the driving motor further comprises:

an encoder magnet installed on the motor shaft to rotate together with the motor shaft; and an encoder sensor disposed to be spaced apart from the motor shaft and configured to detect the rotation of the encoder magnet.

8. The exercise equipment according to claim 6, wherein the bobbin comprises:

a bobbin body formed along the outer surface of the bobbin shaft to rotate together with the bobbin shaft and configured to wind the cable part; and a bobbin sprocket formed along the outer surface at the end of the bobbin shaft to rotate together with the bobbin shaft such that another portion of the timing belt is fastened thereto.

9. The exercise equipment according to claim 8, wherein the cable part is wound according to sequential heights between the bottom and top of the bobbin body.

10. The exercise equipment according to claim 1, wherein a plurality of cable parts are disposed in the body part, and wherein the driving part is independently installed for each cable part.

11. The exercise equipment according to claim 10, further comprising a controller disposed in a space formed between the respective driving parts in the accommodation space and configured to control the driving part.

12. The exercise equipment according to claim 1, further comprising a caster protruding downward from the body part and configured to roll on the ground.

13. The exercise equipment according to claim 12, wherein the caster is installed to move up and down with respect to the body part in order to determine whether it protrudes or does not protrude from the body part.

14. The exercise equipment according to claim 1, further comprising a guide wall configured to guide an extension section of the cable part extending between the driving part and the outlet.

15. The exercise equipment according to claim 14, wherein the guide wall comprises:

a guide wall body formed to extend in part or all of the section between the driving part and the outlet to restrict the cable part from moving in a direction other than the longitudinal direction; and a plurality of guide holes formed intermittently along the longitudinal direction of the guide wall body to have a shape perforating the guide wall body.

16. The exercise equipment according to claim 1, wherein the body part comprises:

a first body constituting part of the body part; and a second body constituting the remaining part of the body part and capable of being assembled with the first body.

17. The exercise equipment according to claim 16, wherein concavo-convex surfaces are respectively formed in the assembled portions of the first body and the second body to correspond to each other, so that the concavo-convex surfaces engage with each other when assembling the first body and the second body.

18. The exercise equipment according to claim 17, wherein the first body and the second body are formed to be symmetrical to each other.

19. The exercise equipment according to claim 1, further comprising an outlet part installed in the outlet such that the cable part passes therethrough, and configured to buffer pressure due to changes in the pulling trajectory of the cable part.

20. The exercise equipment according to claim 19, wherein the cable part comprises a cable stopper formed at the other end of the cable part so as to be stopped by the outlet part when the pulled length is reduced.

21. The exercise equipment according to claim 20, further comprising a handle coupled to the other end of the cable part so as to be gripped by a user to apply external force, wherein the cable part further comprises a handle connector formed on the other end such that the handle is detachably coupled thereto.

* * * * *